US009890505B2

(12) United States Patent
Shamsai

(10) Patent No.: US 9,890,505 B2
(45) Date of Patent: Feb. 13, 2018

(54) PRECAST CONCRETE BEAM

(71) Applicant: QUICKCELL TECHNOLOGY PTY LTD, Milton (AU)

(72) Inventor: Mohammad Hossein Shamsai, Milton (AU)

(73) Assignee: QUICKCELL TECHNOLOGY PTY LTD, Brisbane (AU)

( * ) Notice: Subject to any disclaimer, the term of this patent is extended or adjusted under 35 U.S.C. 154(b) by 0 days.

(21) Appl. No.: 15/103,829

(22) PCT Filed: Dec. 10, 2014

(86) PCT No.: PCT/AU2014/050414

§ 371 (c)(1),
(2) Date: Jun. 10, 2016

(87) PCT Pub. No.: WO2015/085367

PCT Pub. Date: Jun. 18, 2015

(65) Prior Publication Data

US 2016/0305077 A1 Oct. 20, 2016

(30) Foreign Application Priority Data

Dec. 11, 2013 (AU) ..... 2013904822
Sep. 4, 2014 (AU) ..... 2014221234
Sep. 4, 2014 (NZ) ..... 630140

(51) Int. Cl.
*E01D 2/02* (2006.01)
*E04C 3/26* (2006.01)
(Continued)

(52) U.S. Cl.
CPC ..... *E01D 2/02* (2013.01); *E04B 5/06* (2013.01); *E04C 3/26* (2013.01); *E01D 2101/26* (2013.01); *E01D 2101/28* (2013.01)

(58) Field of Classification Search
CPC ... E01D 2/02; E01D 2102/28; E01D 2101/26; E04B 5/06; E04C 3/26
See application file for complete search history.

(56) References Cited

U.S. PATENT DOCUMENTS 8,453,406 B2 * 6/2013 Platt ..... E04C 3/294 14/73.1
8,539,629 B2 9/2013 Han
(Continued)

FOREIGN PATENT DOCUMENTS

DE 949774 C * 9/1956 ..... E04B 5/06
DE 1099714 B * 2/1961 ..... E04B 5/06
(Continued)

OTHER PUBLICATIONS

HPC Bridge Views—High Strength Concrete for the Hoosick River Crossing . . . HPC Bridge Views, Issue 66, Mar./Apr. 2011.

*Primary Examiner* — Jeanette E Chapman
(74) *Attorney, Agent, or Firm* — Troutman Sanders LLP

(57) ABSTRACT

A precast concrete beam including a substantially planar web extending longitudinally between ends of the beam; a pair of flanges formed integrally with the web, each flange extending laterally from an elongate edge of the web and extending longitudinally between the ends of the beam so as to define a structure engaging surface of the beam; and a plurality of diaphragms formed integrally with the web and the flanges, each diaphragm spanning laterally between a side of the web and one of the flanges, wherein the diaphragms are spaced apart along the beam to thereby support the flanges.

19 Claims, 19 Drawing Sheets

(51) Int. Cl.

| | |
|---|---|
| ***E04B 5/06*** | (2006.01) |
| *E01D 101/26* | (2006.01) |
| *E01D 101/28* | (2006.01) |

(56) References Cited

U.S. PATENT DOCUMENTS

| | | | | |
|---|---|---|---|---|
| 2009/0077758 | A1 | 3/2009 | Vincent | |
| 2009/0288355 | A1* | 11/2009 | Platt | E04B 5/23 52/223.1 |
| 2013/0263392 | A1 | 10/2013 | Han | |
| 2013/0269125 | A1* | 10/2013 | Grace | E01D 19/125 14/73 |

FOREIGN PATENT DOCUMENTS

| | | | | | |
|---|---|---|---|---|---|
| DE | 2139035 | A1 | * | 2/1973 | E01D 2/02 |
| DE | 29902384 | U1 | * | 7/2000 | E04B 2/8617 |
| FR | 58390 | E | * | 11/1953 | E04B 5/04 |
| GB | 408528 | A | | 4/1934 | |
| GB | 602153 | A | * | 5/1948 | E04B 1/58 |
| GB | 770472 | A | | 3/1957 | |
| KR | 1020130107870 | A | | 10/2013 | |
| WO | WO-2012044094 | A2 | * | 4/2012 | E01D 2/02 |

* cited by examiner

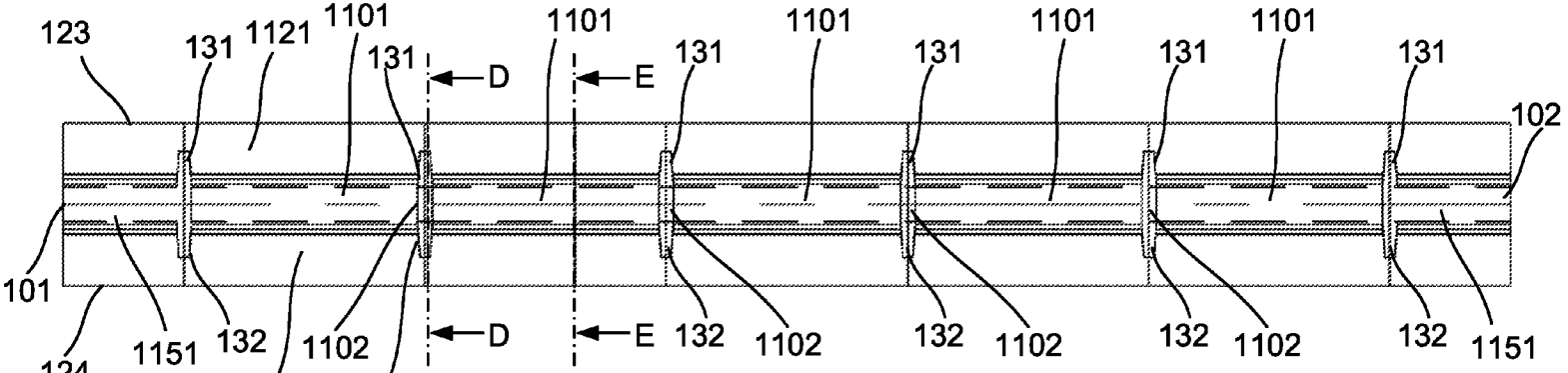
Fig. 11C
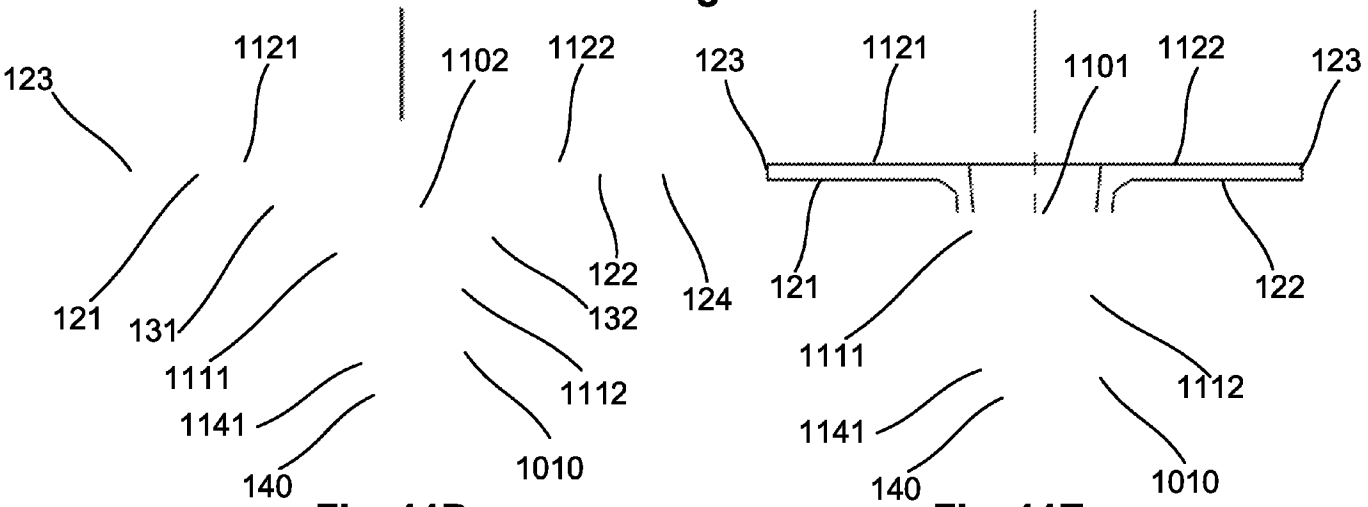
Fig. 11D
Fig. 11E

PRECAST CONCRETE BEAM

CROSS REFERENCE TO RELATED APPLICATIONS

This application is a United States national stage entry of an International Application serial no. PCT/AU2014/050414 which claims the benefit of Australian Patent Application No. 2014221234, filed Sep. 4, 2014, New Zealand Patent Application No. 630140, filed Sep. 4, 2014, and Australian Patent Application No. 2013904822, filed Dec. 11, 2013, the disclosures of which are included herein by reference.

BACKGROUND OF THE INVENTION

The present invention relates to precast concrete beams, being particularly suitable for use in the construction of bridges or the like.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

It is known to use precast concrete beams in the conventional construction of bridges and other related structures. A range of different beam types may be used depending on the particular structural application. Many of the available types of beams are commonly characterised by their cross section shape.

Tee beams are one broad type of beam that has been conventionally utilised in bridge construction. Their characteristic "T"-shaped cross section will generally be provided by a vertical web topped with horizontal flanges for supporting a deck slab, such as for providing a road surface. Prestressed reinforcement members will often be provided within the Tee beam, particularly in its base. The width of a Tee beam will be practically limited by the ability of the cantilevered horizontal flanges to distribute loads from their edges to the vertical web.

So-called Super-Tee beams have been found to be particularly suitable for long-span bridge construction, such as for highways and the like. This variant of the Tee beam typically has a "U"-shaped central portion which replaces the vertical web of the Tee beam. The bottom of the "U" forms a base of the beam and horizontal flanges extend laterally from top of the upwardly extending parts of the "U". This arrangement can allow for greater beam widths because the flanges are supported from points offset from the centreline of the beam, although the flanges are still cantilevered. The base may be thickened for additional bending strength and to accommodate reinforcement members.

Although Super-Tee beams provide significant strength improvements over conventional Tee beam designs, allowing for longer bridge spans and/or a reduced number of beams to provide a bridge of a particular width, the Super-Tee beams are comparatively heavy and also have disadvantages with regard to inspectability.

The flanges of a Super-Tee beam may be provided in two different configurations—namely open-flange where the open top of the "U" is left open, and closed-flange where the flanges meet in the centre to close the top of the "U". In the closed-flange configurations, an internal cavity within the "U"-shaped upright portion will be enclosed when the beam is formed, and whilst this provides an effective box-section for improved torsional rigidity. The open-flange configurations will require the deck slab to span the open top of the "U", which also defines an internal cavity in use. In either case, this internal cavity can be problematic as it represents a significant surface area of the beam which cannot be externally inspected for cracks or the like, and the cavity may also require draining to prevent the collection of water.

Furthermore, different Super-Tee beam sizes generally need to be provided with different depths and widths to suit different requirements, but if it desirable to standardise the size for other reasons there will be a substantial weight and cost penalty.

Accordingly, whilst the Super-Tee beam has provided some improvements in possible spans and widths compared to conventional Tee beams, it is desirable to provide new beam configurations which may provide further improvements or at least provide a suitable alternative to the Super-Tee beam without one or more of the associated downsides.

SUMMARY OF THE PRESENT INVENTION

In a first broad form the present invention seeks to provide a precast concrete beam including:

a) a substantially planar web extending longitudinally between ends of the beam;

b) a pair of flanges formed integrally with the web, each flange extending laterally from an elongate edge of the web and extending longitudinally between the ends of the beam so as to define a structure engaging surface of the beam; and, c) a plurality of diaphragms formed integrally with the web and the flanges, each diaphragm spanning laterally between a side of the web and one of the flanges, wherein the diaphragms are spaced apart along the beam to thereby support the flanges.

Typically the beam is cast from concrete as a unitary body.

Typically the beam includes at least one pair of diaphragms such that the diaphragms in each pair span between respective sides of the web and respective flanges at the same longitudinal position along the beam.

Typically the beam includes a plurality of pairs of diaphragms, each pair of diaphragms being spaced apart by a spacing distance.

Typically the spacing distance is selected so that a load applied to an outer portion of one of the flanges will be transmitted to the web via one of the diaphragms.

Typically the spacing distance is selected to be less than 30 times a flange thickness of the flanges.

Typically the spacing distance is selected to be between 20 times the flange thickness and 30 times the flange thickness.

Typically each diaphragm defines a substantially straight outer edge extending from the flange towards a second elongate edge of the web opposing the flanges.

Typically each diaphragm is substantially triangle shaped.

Typically the structure engaging surface is a substantially planar surface.

Typically the beam includes a plurality of reinforcement members located inside the beam.

Typically at least some of the reinforcement members are prestressed when the beam is formed.

Typically the beam further includes an enlarged bulb formed integrally with the web, the bulb extending along a second elongate edge of the web opposing the flanges.

Typically a portion of each diaphragm is connected to the bulb.

Typically the beam includes an array of reinforcement members located inside the bulb.

Typically the beam includes an end block at each end, each end block being formed integrally with an end portion of the web and having a substantially increased thickness compared to a thickness of the web.

Typically reinforcement members located inside the beam are terminated at the end block.

Typically the end block and the bulb define a substantially planar support surface of the beam.

Typically the beam includes two secondary beams, each secondary beam being formed integrally with one of the flanges and extending longitudinally between ends of the beam.

Typically the two secondary beams are offset laterally from opposing sides of the web.

Typically each secondary beam protrudes from the flange away from the structure engaging surface.

Typically each secondary beam is located at an intermediate position with respect to the perpendicular extension of the respective flange from the web, such that an inner flange portion is defined between the web and the secondary beam and an outer flange portion is defined extending outwardly from the secondary beam.

Typically each diaphragm extends between the inner flange portion and the web.

Typically each secondary beam is located at an outer edge of the flange.

Typically each diaphragm terminates at a respective secondary beam.

Typically the secondary beam has a cross section profile of one of:

a) a square shape;
b) a rectangular shape;
c) a triangular shape;
d) a rounded shape; and,
e) a semi-circular shape.

Typically a spacing distance between the diaphragms is selected to be less than 20 times a secondary beam depth of the secondary beams.

Typically the spacing distance is selected to be between 15 times the secondary beam depth and 20 times the secondary beam depth.

Typically the structure engaging surface is configured to engage a slab.

Typically a spacing distance between the diaphragms is selected so that loads applied to the slab will be transmitted to the web via the diaphragms.

Typically at least one of the diaphragms includes a service hole for allowing services to be routed through the diaphragm.

Typically the flanges extend laterally from the web at an angle to define a sloped structure engaging surface.

Typically the beam includes laterally extending internal reinforcements in at least some longitudinal positions along the beam.

Typically the beam includes laterally extending internal reinforcements at least at longitudinal positions coinciding with the diaphragms.

Typically the beam includes diagonal beams extending between adjacent diaphragms.

Typically the diagonal beams extend from a base of a first diaphragm to an end of a second diaphragm adjacent to the first diaphragm.

Typically the beam includes an integral slab portion formed integrally with the flanges, the integral slab portion defining a substantially planar slab surface of the beam.

Typically the slab surface is sloped relative to the web.

Typically the beam includes a recessed region formed along an outer edge of the integral slab portion, to thereby allow adjacent beams to be joined by abutting respective outer edges of the adjacent beams so that the respective recessed regions form an effective joint recess and forming a concrete infill in the effective joint recess.

In a second broad form the present invention seeks to provide a precast concrete beam including:

a) an upright web extending longitudinally between ends of the beam;
b) a pair of flanges formed integrally with the web, each flange protruding laterally from an upper portion of the web and extending longitudinally between the ends of the beam, upper surfaces of the flanges defining a top surface of the beam; and,
c) a plurality of diaphragms formed integrally with the web and the flanges, each diaphragm spanning laterally between a side of the web and a lower surface of one of the flanges, wherein the diaphragms are spaced apart along the beam to thereby support the flanges.

In a third broad form the present invention seeks to provide a precast concrete beam including:

a) a central portion extending longitudinally between ends of the beam;
b) a pair of flanges, each flange being formed integrally with the central portion, each flange extending laterally from a respective elongate edge of the central portion and extending longitudinally between the ends of the beam;
c) an integral slab portion formed integrally with the flanges, the integral slab portion defining a substantially planar slab surface of the beam; and,
d) a recessed region formed along an outer edge of the integral slab portion, to thereby allow adjacent beams to be joined by abutting respective edges of the adjacent beams so that the respective recessed regions form an effective joint recess and forming a concrete infill in the effective joint recess.

Typically the integral slab portion is formed at least in part from thickened regions of the flanges.

Typically the integral slab portion is formed such that the slab surface is aligned with a lateral extension direction of the flanges relative to the central portion.

Typically the central portion is substantially symmetrical about a longitudinally extending symmetry plane and the flanges extend laterally from the central portion at an angle relative to the symmetry plane.

Typically the slab surface is sloped relative to the symmetry plane.

Typically the beam includes reinforcement members embedded into the flanges and protruding into the recessed regions, such that the concrete infill is reinforced by the reinforcement members when adjacent beams are joined.

Typically the beam includes reinforcement couplers embedded into the integral slab portion for supporting reinforcement bars protruding laterally across the recessed regions, such that the concrete infill is reinforced by the reinforcement bars when adjacent beams are joined.

Typically the reinforcement bars extend laterally beyond an outer edge of the beam to thereby protrude into an adjacent recessed region when adjacent beams are joined.

Typically the beam includes a plurality of diaphragms each formed integrally with the flanges and the central portion, each diaphragm spanning laterally between one of the flanges and a side of the central portion, wherein the diaphragms are spaced apart along the beam to thereby support the flanges.

Typically the central portion includes at least one substantially planar web extending longitudinally between ends of the beam.

In a fourth broad form the present invention seeks to provide a precast concrete beam including:

a) a central portion extending longitudinally between ends of the beam;

b) a pair of flanges, each flange being formed integrally with the central portion, each flange extending laterally from a respective elongate edge of the central portion and extending longitudinally between the ends of the beam so as to define a structure engaging surface of the beam; and, c) a plurality of diaphragms each formed integrally with the flanges and the central portion, each diaphragm spanning laterally between one of the flanges and a side of the central portion, wherein the diaphragms are spaced apart along the beam to thereby support the flanges.

Typically the central portion includes at least one substantially planar web extending longitudinally between ends of the beam.

Typically the central portion includes a base defining a support surface of the beam and a pair of opposed webs extending from the base.

Typically the base and opposed webs define a hollow internal volume inside the central portion.

Typically the hollow internal volume is partitioned by one or more internal bulkheads.

Typically each internal bulkhead is aligned with a pair of diaphragms.

Typically the beam includes an integral slab portion formed integrally with the flanges, the integral slab portion defining a substantially planar slab surface of the beam.

Typically the central portion includes a hollow internal volume that is enclosed by the integral slab portion.

Typically the slab surface is sloped relative to the central portion.

Typically the beam includes a recessed region formed along an outer edge of the integral slab portion, to thereby allow adjacent beams to be joined by abutting respective outer edges of the adjacent beams so that the respective recessed regions form an effective joint recess and forming a concrete infill in the effective joint recess.

In a fifth broad form the present invention seeks to provide a precast concrete beam for use in construction of a bridge structure, the beam including:

a) a substantially planar web extending longitudinally between ends of the beam;

b) a pair of flanges formed integrally with the web, each flange extending laterally from a first elongate edge of the web and extending longitudinally between the ends of the beam so as to define a structure engaging surface of the beam;

c) an enlarged bulb formed integrally with the web, the bulb extending along a second elongate edge of the web opposing the flanges, an array of prestressed reinforcement members being located inside the bulb; and, d) a plurality of diaphragms formed integrally with the web and the flanges, each diaphragm spanning laterally between a side of the web and one of the flanges, wherein each diaphragm is substantially triangle shaped and a portion of each diaphragm is connected to the bulb, and wherein the diaphragms are spaced apart along the beam to thereby support the flanges.

BRIEF DESCRIPTION OF THE DRAWINGS

An example of the present invention will now be described with reference to the accompanying drawings, in which:—

FIG. 11C is a schematic top view of the precast concrete beam of FIG. 11A;

FIG. 11D is a schematic cross section view of the precast concrete beam of FIG. 11C at section D'-D";

FIG. 11E is a schematic cross section view of the precast concrete beam of FIG. 11C at section E'-E";

DETAILED DESCRIPTION OF THE PREFERRED EMBODIMENTS

Figure 1A:
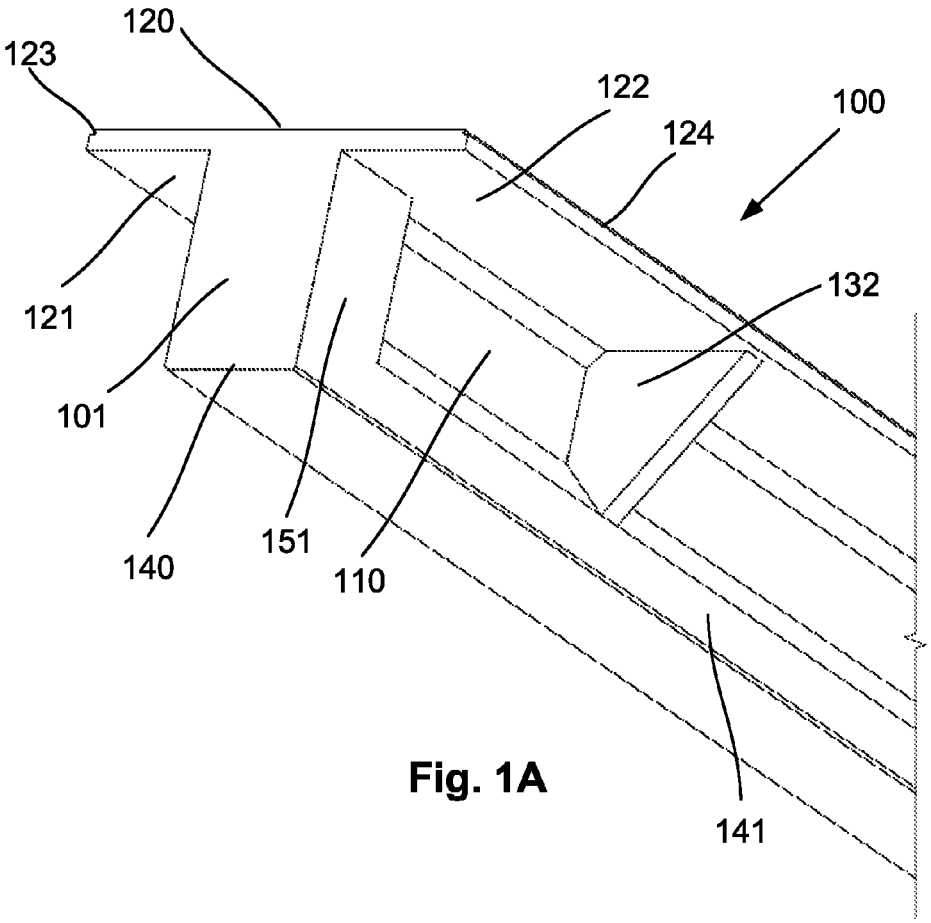
FIG. 1A is a schematic perspective view of an end portion of a first example of a precast concrete beam.

A first example of a precast concrete beam 100 will now be described with reference to FIGS. 1A to 1G.

In broad terms, the beam 100 includes a substantially planar web 110 extending longitudinally between ends 101, 102 of the beam 100 and a pair of flanges 121, 122 which formed integrally with the web 110. Each flange 121, 122 extends laterally from an elongate edge of the web 110 and extends longitudinally between the ends 101, 102 of the beam 100 so as to define a surface engaging surface 120 of the beam 100. In some embodiments each flange 121, 122 may extend perpendicularly from the web 110 although in other embodiments, the flanges 121, 122 may be extend laterally from the web 110 at an angle to define a sloped structure engaging surface, as will be discussed in examples below.

The beam 100 also includes a plurality of diaphragms 131, 132, which are formed integrally with the web 110 and the flanges 121, 122. Each diaphragm 131, 132 spans laterally between a side of the web 110 and one of the flanges 121, 122, and the diaphragms 131, 132 are spaced apart along the beam 100 to thereby support the flanges 121, 122.

It will be appreciated that the web 110 and the flanges 121, 122 can effectively define a "T"-shaped cross section extending along the length of the beam 100, similar to conventional Tee beam designs. This can be best seen in FIG. 1F which shows a cross section view through the basic cross section of the beam. However, the beam 100 further includes integrally formed diaphragms 131, 132 which support the flanges 121, 122 and thus substantially improve the structural performance of the beam 100.

For example, the diaphragms 131, 132 improve the torsional rigidity of the beam 100 compared to a conventional Tee beam, because it prevents the relatively thin beam section from twisting along its length. With appropriate sizing and spacing of the diaphragms 131, 132, the beam 100 can have torsional rigidity comparable to that of a Super-Tee beam, but without the weight penalty associated with providing a constant box-section beam configuration.

The diaphragms 131, 132 support the flanges 121, 122 such that loads applied to the flanges 121, 122 can be transferred into the central web 110 via the diaphragms 131, 132. Thus, it will be understood that this can allow for flanges 121, 122 that are relatively thinner and/or wider compared to the flanges 121, 122 of conventional Tee beam and Super-Tee beam designs, in which the flanges are cantilevered from the web and thus rely on bending of the flanges about the edge of the web to which the roots of the flanges are connected.

It will be appreciated that this can in turn allow for wider beams to be provided without the usual weight penalty that would otherwise be incurred by the need to increase the thickness to withstand higher bending loads. The total width of the beam 100 can be adjusted to suit the particular geometry of the design and is guided by the overall length of the beam 100 and the spacing between the diaphragms 131, 132. The wider the beam 100, the less the number of beams 100 required to build a bridge, leading to further economy.

Accordingly, the above discussed configuration of the beam 100 may allow wider beams to be provided whilst maintaining sufficient structural strength and rigidity for use in long spans. This can enable a reduction in the number of required beams in conventional bridge construction. For example, a normal span needs to be covered by six standard Super-Tee's, whereas suitable embodiments of the beam 100 may be provided which reduce the required number of beams to four, without compromising on the structural integrity of the bridge.

Furthermore, in comparison with the standard Super-Tee beam, the surface area of the beam 100 is totally exposed for inspection over its lifetime, whereas the standard Super-Tee beam will contain large internal cavities which are not accessible.

It will therefore be appreciated that the above discussed configuration of the beam 100 is capable of offering substantial improvements over conventional precast concrete beam designs.

The beam 100 will typically be cast from concrete as a unitary body. Accordingly, the web 110, flanges 121, 122 and diaphragms 131, 132 will be integrally formed together in the same casting process. Thus the beam 100 can be manufactured using known techniques in its entirety at a dedicated facility and transported to a remote site for constructing a bridge.

Further optional features will now be described with reference to the example embodiment of the beam 100 depicted in FIGS. 1A to 1G.

Figure 1B:
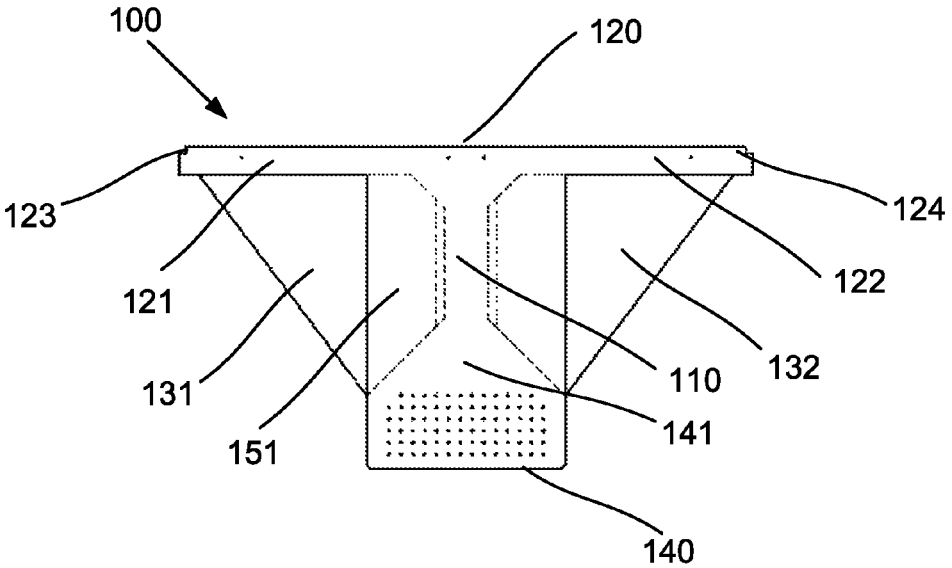
FIG. 1B is a schematic end view of the precast concrete beam of FIG. 1A.

As per the illustrated example the beam 100 may include pairs of diaphragms 131, 132 such that the diaphragms 131, 132 in each pair span between respective sides of the web 110 and respective flanges 121, 122 at the same longitudinal position along the beam 100. FIG. 1G shows a cross section view through such a pair of diaphragms 131, 132. This arrangement will generally be preferred as each pair of diaphragms 131, 132 will cooperate to provide a larger effective shear plane through the cross section of the beam 100. However, the diaphragms 131, 132 may alternatively be provided in non-paired arrangements, such as by providing diaphragms 131, 132 on respective sides of the web 100 in a staggered arrangement.

Figure 1C:
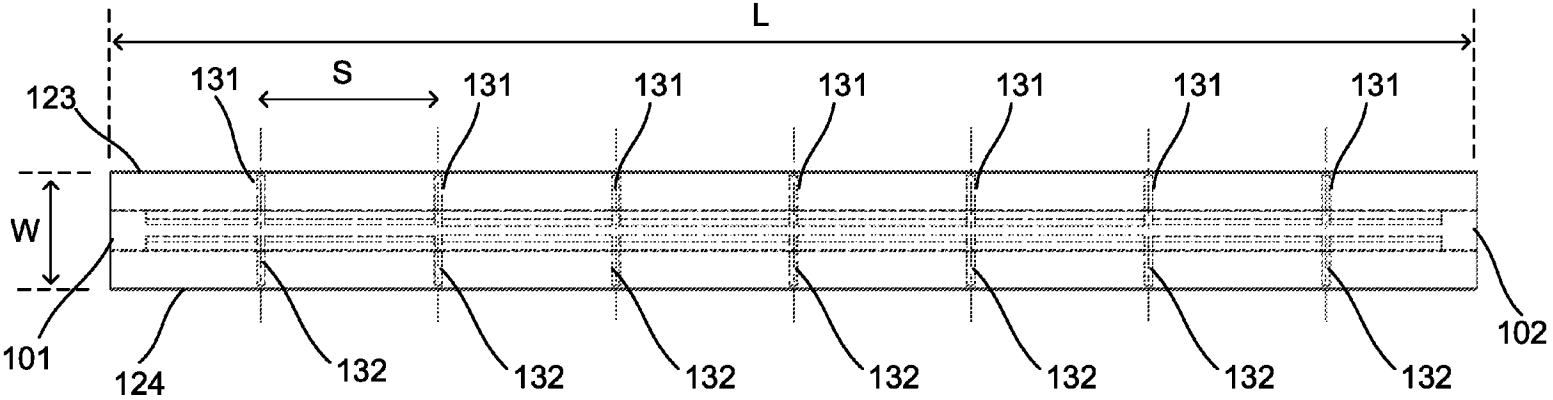
FIG. 1C is a schematic top view of the precast concrete beam of FIG. 1A.
Figure 1D:
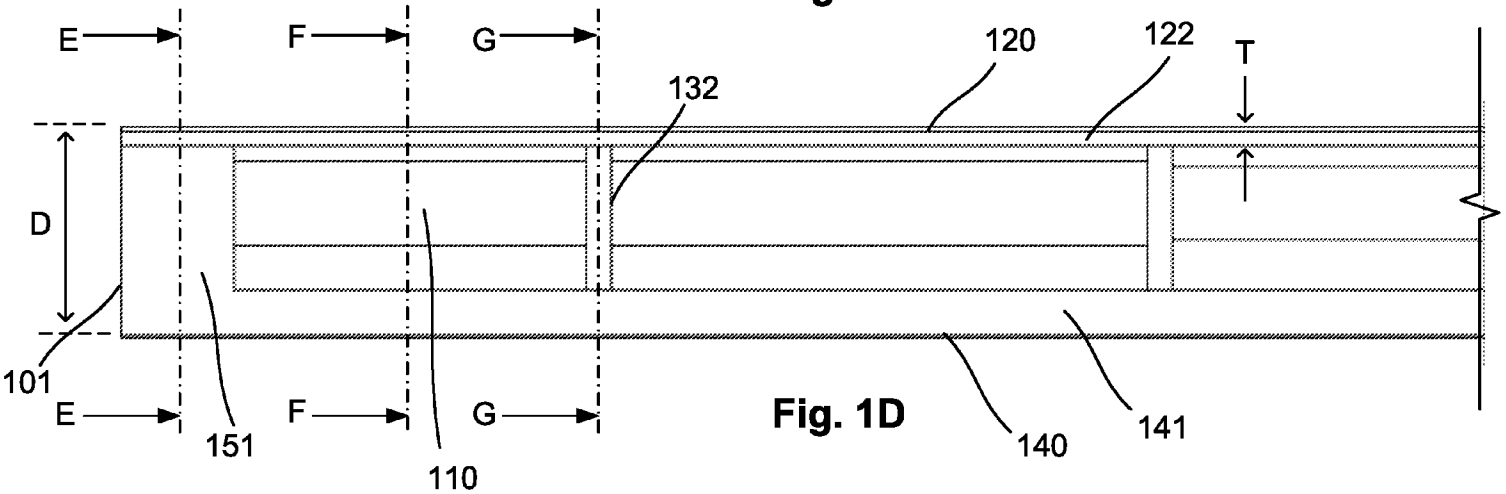
FIG. 1D is a schematic side view of the end portion of the precast concrete beam of FIG. 1A.

As can be seen from FIGS. 1C and 1D, in the present example, the beam 100 includes a plurality of pairs of diaphragms 131, 132, and each pair of diaphragms 131, 132, is spaced apart by a spacing S. Other dimensions of the beam 100 can also be seen in FIGS. 1C and 1D, namely the length L, width W and depth D of the beam 100, and the flange thickness T. Each of these dimensional parameters will be determined depending on the requirements for the beam, such as the required span of the bridge, number of beams required, the expected loading of the bridge, etc. Specific sizing of thicknesses of the web 110, flanges 121, 122 and diaphragms 131, 132 will also be a factor in the selection of the overall dimensions of the beam 100.

The spacing S between each pair of diaphragms 131, 132 will be of particular significance in the design of the beam 100, as this will play an important role in allowing thinner and wider flanges 121, 122 to be provided, thus enabling the above described benefits associated with providing a wider beam 100.

In one example design approach, the spacing S may be selected so that a load applied to an outer portion of one of the flanges 121, 122 will be transmitted to the web 110 via one of the diaphragms 131, 132. For example, this may involve using a spacing S that is less than twice the width of one of the flanges 121, 122, so that the distance a load needs to be transmitted from the outermost edge of the flange 121, 122 to the diaphragm 131, 132 is less than the distance that the load would otherwise need to be transmitted to the web 110 by bending.

However, it will be understood that this is a simplified criteria and in practice the design of the spacing S should account for such factors as the different degrees of support provided by the diaphragms 121, 122 to a load applied to one of the flanges 121, 122 compared to the web 100. For instance, one of the flanges 121, 122 may be considered to have a fixed support at its connection with the web 100 but each portion of the flange 121, 122 between two adjacent diaphragms 131, 132 may be considered to be simply supported between them. In reality, the true support conditions will not be either of these ideals and criteria for the appropriate spacing S of the diaphragms may be determined by modelling the response of the beam to loading using Finite Element Analysis (FEA) or other suitable techniques.

In some examples, the spacing S may be selected with regard to other dimensions of the beam 100, such as the thickness T of the flanges 121, 122. It will be appreciated that this may provide a useful dimensional relationship because, as discuss previously, there is an interrelationship between the spacing of the diaphragms 131, 132 and the need for bending strength of the flanges 121, 122. In one example, the spacing S may be selected to be less than 30 times a flange thickness T of the flanges 121, 122. This has been found to ensure the diaphragms 131, 132 provide suitable support for the flanges 121, 122 along the length of the beam 100. In one example the spacing S may be selected to be between 30 times the flange thickness T and 20 times the flange thickness T.

As shown in FIGS. 1B and 1G, each diaphragm 131, 132 may define a substantially straight outer edge extending from the flange 121, 122 towards a second elongate edge of the web 110 opposing the flanges 121, 122. It will be understood that this provides a structurally effective support geometry with efficient use of materials. In this particular example, each diaphragm is substantially triangle shaped, particularly with regard to the basic "T"-shape of the web 110 and flanges 121, 122.

As discussed above, the flanges 121, 122 define a structure engaging surface 120, which can allow the beams 100 to support part of a bridge structure such as a deck slab. In this example the structure engaging surface 120 is a substantially planar surface. Thus, a number of the beams 100 can be arranged side to side with their planar structure engaging surfaces 120 aligned to define a larger planar surface upon which a deck slab of topping concrete may be poured, such as to provide a flat road surface on a highway bridge. The flanges 121, 122 may include notches or grooves on structure engaging surface 120 at their edges 123, 124, such that when the edges 123, 124 of two adjacent beams are abutted together, the notches or grooves define an effective channel. This channel can be filled by the topping concrete material and provide a shear key which assists the lateral stability of the assembly of beams 100.

Figure 1E:
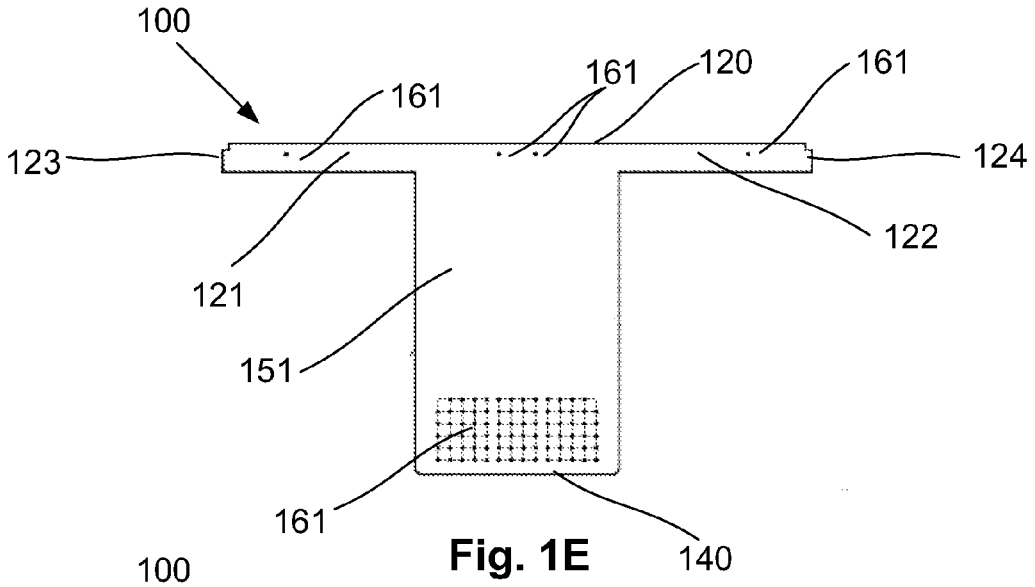
FIG. 1E is a schematic cross section view of the precast concrete beam of FIG. 1D at section E'-E"
Figure 1F:
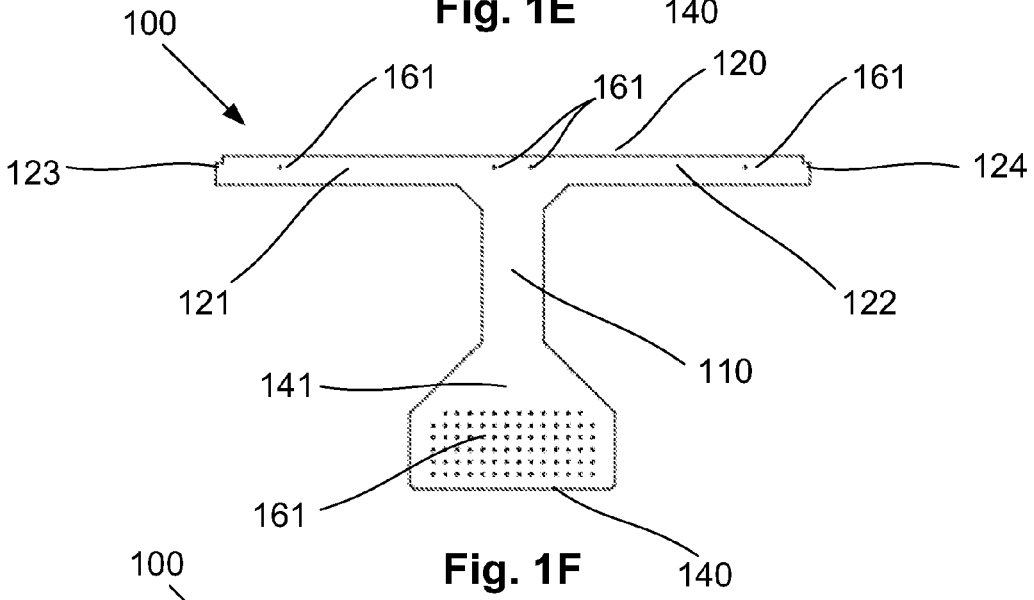
FIG. 1F is a schematic cross section view of the precast concrete beam of FIG. 1D at section F'-F"
Figure 1G:
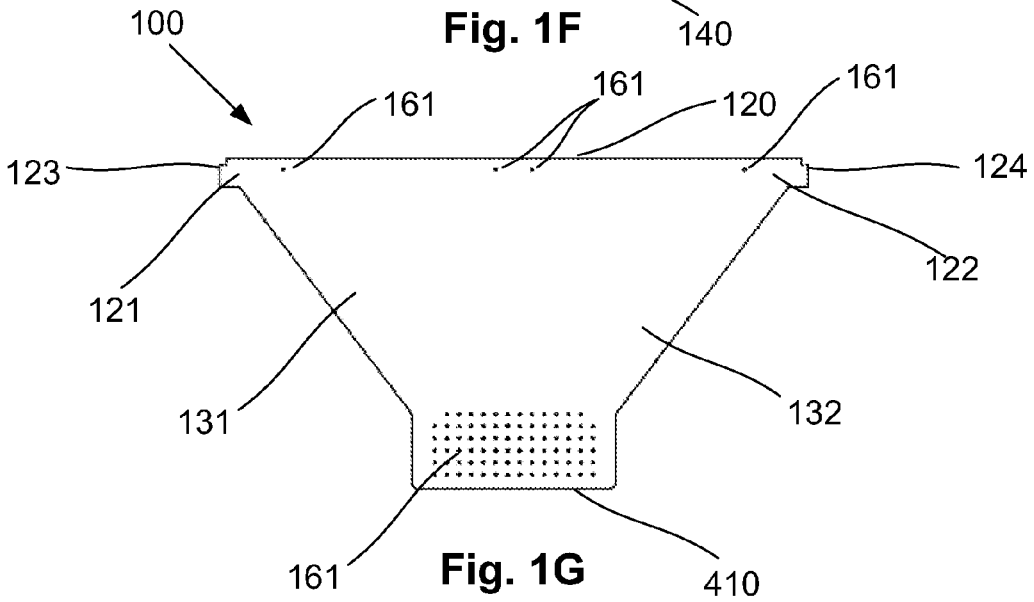
FIG. 1G is a schematic cross section view of the precast concrete beam of FIG. 1D at section G'-G"

With regard to the cross section views of FIGS. 1E to 1G, it will be seen that the beam 100 may include a plurality of reinforcement members 161 located inside the beam. These reinforcement members may be provided in the form of bars, rods, cables or strands, generally made from a material having a relatively high tensile strength compared to the concrete used to make the precast concrete beam 100, such as steel. The reinforcement members 161 extend longitudinally along the length of the beam 100 in this example, although it will be understood that reinforcement members 161 can also be provided in other orientations as required.

In preferred embodiments, at least some of the reinforcement members 161 will be prestressed when the beam 100 is formed. This may be achieved by positioning the reinforcement members 161 within formwork used in the casting process and placing the reinforcement under tensile loading before the main body of the beam 100 is cast in concrete. This will cause portions of the beam 100 in the vicinity of the prestressed reinforcement members 161 to be in a compressed state, which desirable allows for increased tensile load bearing capacity since concrete can otherwise be prone to cracking failures under tension.

In the present example, the beam 100 further includes an enlarged bulb 141 formed integrally with the web 110, such that the bulb 141 extends along the second elongate edge of the web 110 opposing the flanges. The bulb 141 can provide additional bending strength to the beam 100, and can also further improve the torsional rigidity along the entire cross section of the beam 100. The bulb 141 may also define a wider support surface 140 of the beam 100, which can allow the beam 100 to be more readily transported by resting the beam 100 on its support surface 140. In this example, a lower region of each diaphragm 131, 132 is connected to the bulb 141.

The beam 100 may include an array of reinforcement members 161 located inside the bulb, as shown in FIGS. 1E to 1G. This positioning of the reinforcement members 161 is particularly useful because the beam 100 will typically be under bending loading when used in the construction of a bridge which can cause tensile loading of the bulb 141. As mentioned above, these reinforcement members 161 will preferably be prestressed to increase the tensile load bearing capacity of the bulb 141.

Other reinforcement members 161 may be provided in other portions of the beam 100 as required, and in this case there are four reinforcement members 161 positioned across the flanges 121, 122.

The beam 100 may also include an end block 151 at each end 101, 102, which is formed integrally with an end portion of the web 110 and which has a substantially increased thickness compared to the thickness of the web 110. Accordingly, the end block 151 provides a thick section of concrete which can carry concentrated stresses where the beam 100 rests on supports, such as lateral support beams in a bridge.

The prestressed reinforcement members located inside the beam 100 will also typically terminate at the end block 151. The end block 151 and the bulb 141 will preferably define a substantially planar support surface 140 of the beam 100.

A second example of a precast concrete beam 200 will now be described with reference to FIGS. 2A to 2G. It will be noted that the beam 200 shares a number of similarities with the previous example beam 100 and therefore similar features have been assigned similar reference numerals.

The primary difference in the present example beam 200 lies in the configuration of the flanges 121, 122 and the connection of the diaphragms 131, 132 thereto. In this case, the flanges 121, 122 are even wider than in the previous example, and may extend beyond the diaphragms as shown.

This is possible due to the inclusion of two secondary beams 271, 272, which are each formed integrally with one of the flanges 121, 122 and extend longitudinally between ends 101, 102 of the beam 100. In this example, the two secondary beams 271, 272 are offset laterally from opposing sides of the web 110.

The secondary beams 271, 272 span between the diaphragms 131, 132, and provide additional support to the flanges 121, 122. In particular, the secondary beams 271, 272 accommodate load distribution at the structure engaging surface 120 of the beam 100, particularly during the installation and application of topping concrete to form the deck slab of a highway bridge or the like. In the absence of the secondary beams 271, 272, flanges 121, 122 of the same widths would need to be substantially thicker, which would then add more weight to the beam, which is undesirable. Thus, the secondary beams 271, 272 allow the flanges 121, 122 to be even thinner and lighter but still wider than the flanges of a conventional Tee beam or Super-Tee beam.

The flanges 121, 122 will be supported by the secondary beams 271, 272 in the longitudinal direction and by the diaphragm 131, 132 in the lateral direction. Thus, in this example beam 200, the flanges 121, 122 and the secondary beams 271, 272 have the function of transferring loads on to diaphragms 131, 132 from which the loads will be transferred onto the web 110 and other central portions of the beam 100, such as the bulb 141.

As shown in FIGS. 2A to 2G, each secondary beam 271, 272 protrudes from the respective flanges 121, 122 away from the structure engaging surface 120. It will be appreciated that this will preserve the planar structure engaging surface 120 of the beam 100, whilst providing an effective enlarged element for providing the secondary beam 271, 272 on the underside where protrusions will not be of any detriment to the final road surface. In some examples, additional reinforcement members may be located within the secondary beams 271, 272.

Figure 2A:
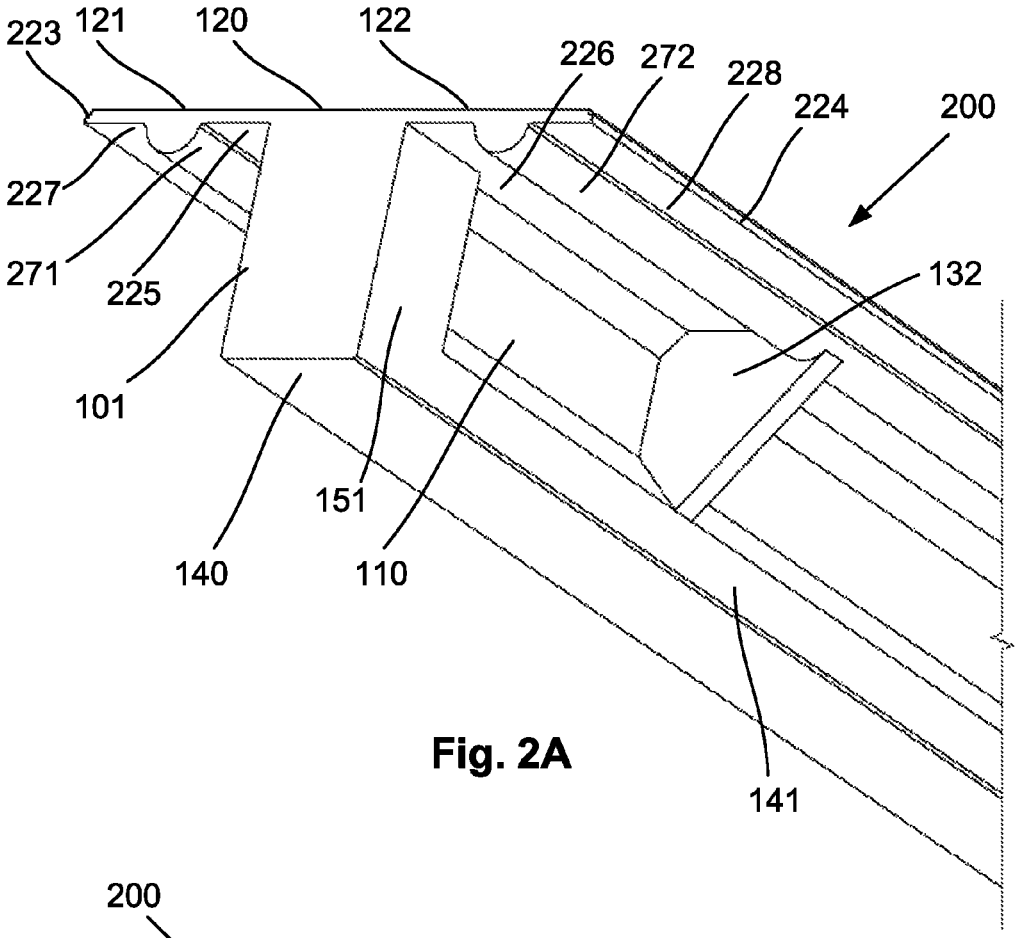
FIG. 2A is a schematic perspective view of an end portion of a second example of a precast concrete beam.
Figure 2B:
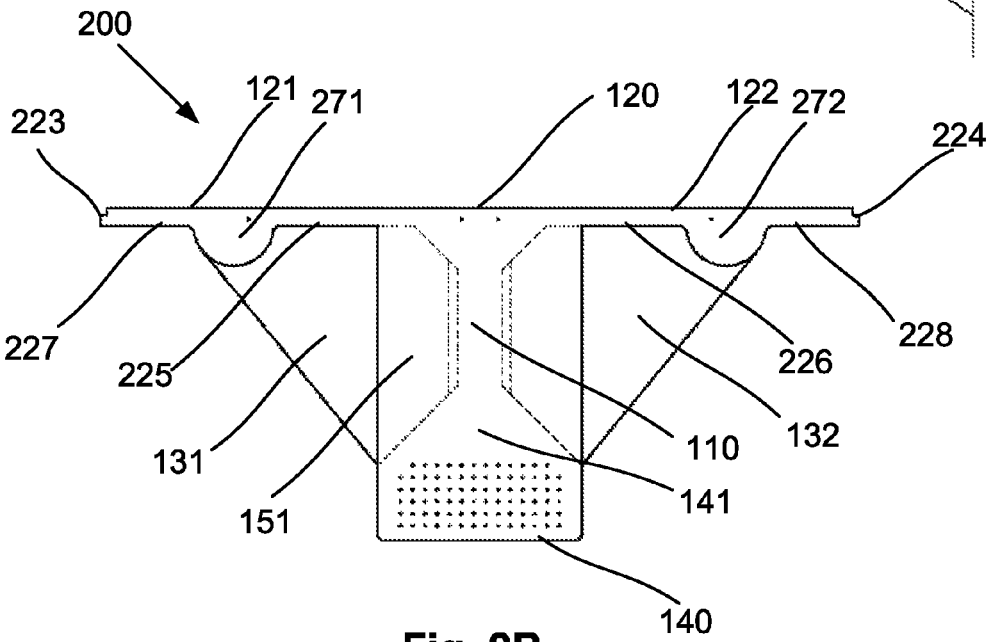
FIG. 2B is a schematic end view of the precast concrete beam of FIG. 2A.
Figure 2C:
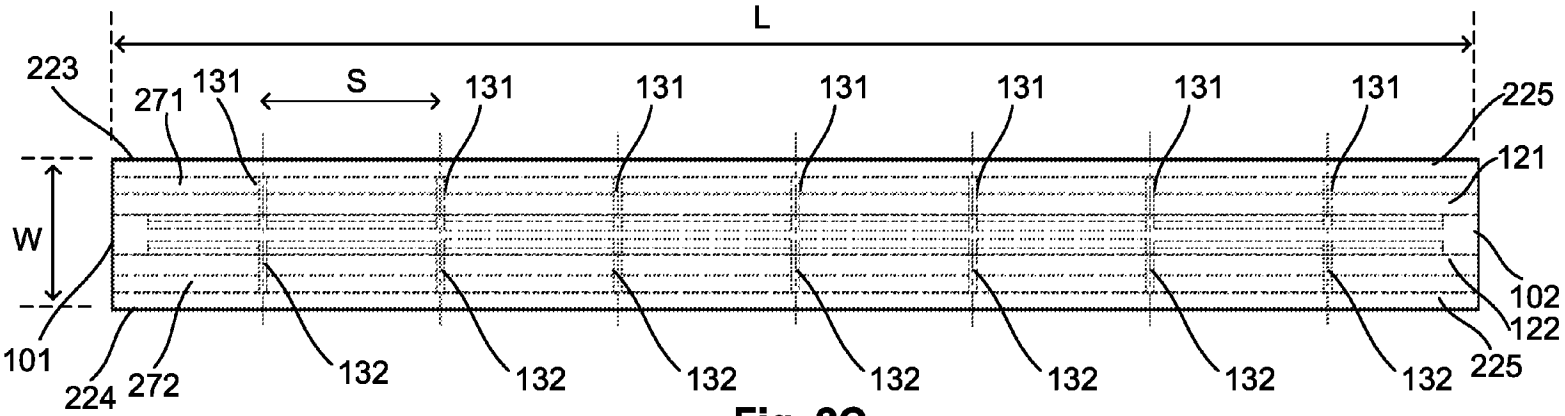
FIG. 2C is a schematic top view of the precast concrete beam of FIG. 2A.
Figure 2D:
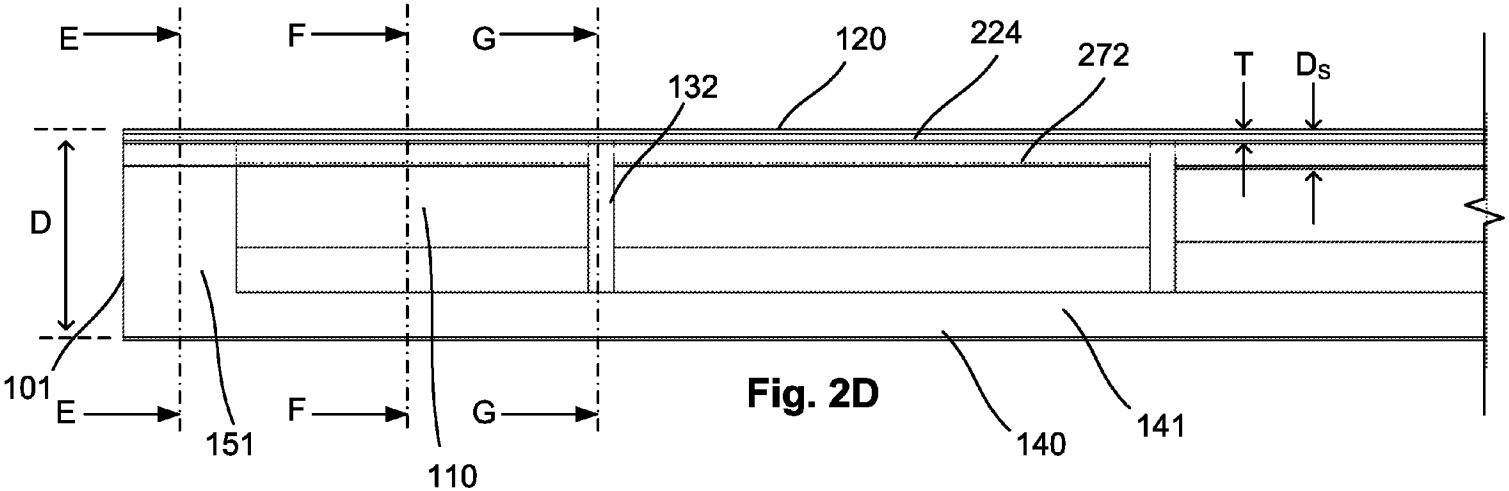
FIG. 2D is a schematic side view of the end portion of the precast concrete beam of FIG. 2A.
Figure 2E:
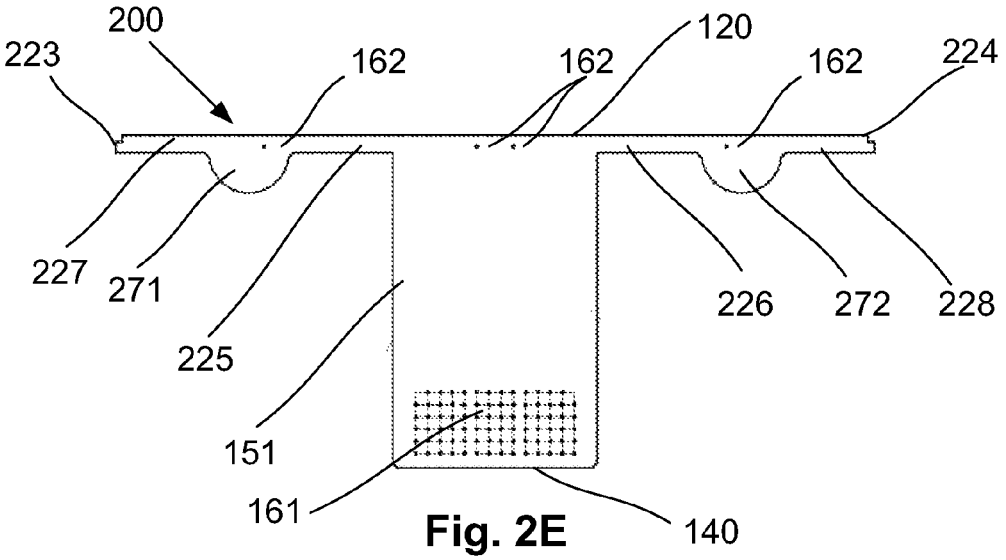
FIG. 2E is a schematic cross section view of the precast concrete beam of FIG. 2D at section E'-E"

With regard to FIG. 2D, it will be seen that the secondary beams 271, 272 protrude from the structure engaging surface 120 by a secondary beam depth $D_S$ which is substantially greater than the flange thickness T. By appropriate selection of this dimension of the secondary beams 271, 272, the flange thickness T can be further reduced, since loads applied to the structure engaging surface 120 will be transmitted to the diaphragms 131, 132 primarily via the secondary beams 271, 272 rather than via the flanges 121, 122 as per the earlier example.

Thus, in examples including the secondary beams 271, 272, the spacing S between the diaphragms 131, 132 can be selected with regard to the secondary beam depth $D_S$ rather than the flange thickness T. In one example, the spacing S between the diaphragms 131, 132 is selected to be less than 20 times the secondary beam depth $D_S$. In a preferred example the spacing S may be selected to be between 20 times the flange thickness T and 15 times the flange thickness T.

Representative dimensions of the example beam 200 shown in FIGS. 2A to 2G will now be outlined. In this example, the total beam length L is about 30,800 mm, and the beam cross section has an overall beam width W of about 3,420 mm and beam depth D of about 1,500 mm. In this case, the flange thickness T is about 80 mm and the secondary beam depth $D_S$ is about 260 mm. The beam 200 includes seven pairs of diaphragms 131, 132, having a diaphragm spacing S between each adjacent pair of diaphragms 131, 132 of about 4,000 mm. It will be appreciated that this satisfies the above discussed dimensional relationship of selecting the spacing S to be less than 20 times the secondary beam depth $D_S$.

Embodiments of beams 200 as discussed above are particularly well suited for use in constructing highway bridge structures, as will be further discussed in due course. However, it will be appreciated that the final dimensions of suitable beams formed in accordance with the design principles discussed above will be selected based on particular applications, expected loadings and other design criteria and may vary widely from the representative dimensions outlined above.

Figure 2F:
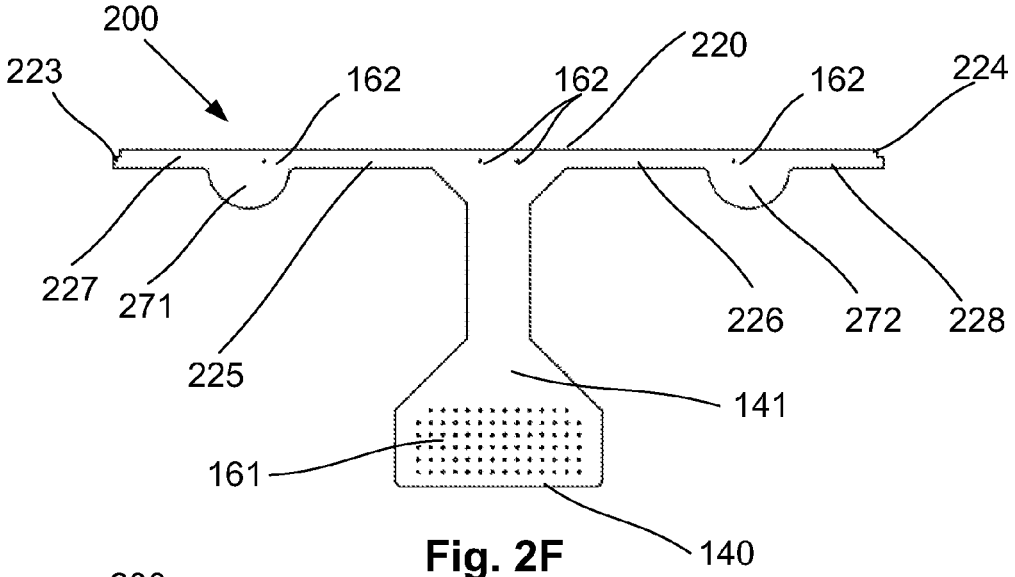
FIG. 2F is a schematic cross section view of the precast concrete beam of FIG. 2D at section F'-F"
Figure 2G:
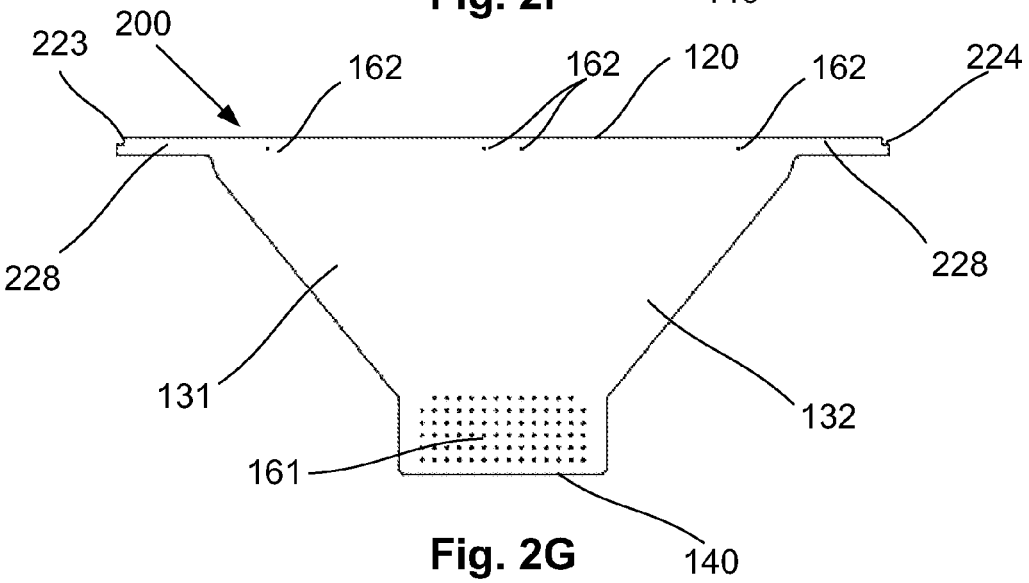
FIG. 2G is a schematic cross section view of the precast concrete beam of FIG. 2D at section G'-G"

In the present example, each secondary beam 271, 272 is located at an intermediate position with respect to the lateral protrusion of its respective flange 121, 122. As a result, an inner flange portion 225, 226 is defined between the web 110 and each secondary beam 271, 272 and an outer flange portion 227, 228 is defined extending outwardly from each secondary beam 271, 272, as best shown in FIG. 2F.

As shown in FIG. 2B, each diaphragm 131, 132 extends between the inner flange portion 225, 226 and the web 110, so that the outer flange portions 227, 228 extend beyond the diaphragms 131, 132. This is not essential, and in some embodiments the diaphragms 131, 132 may span the full widths of the flanges 121, 122. However, it has been found that at least some of each flange 121, 122 can be cantilevered from the secondary beams 271, 272 without requiring the support of the diaphragms 131, 132. It will be appreciated that this provides for even further expansion in the total width of the beam 200.

In this example, each diaphragm 131, 132 terminates at a respective secondary beam 271, 272, which advantageously provides a direct load path from the secondary beams 271, 272 to the web 110.

An example of a portion of a bridge structure 300 using beams 200 as described above is shown in FIGS. 3A to 3C, and will now be described. In this example, five beams 200 are arranged side to side and supported at their ends 101, 102 on lateral support beams 301. A deck slab 302 of topping concrete has been poured across the structure engaging surfaces 120 of the beams 200 to define a road surface. Concrete barriers 303 and edge caps 304 are fitted on the outer edges of the bridge structure 300. As shown in FIG. 3B, the end blocks 151 of the beams 200 are supported by the lateral support beams 301, providing a good distribution of stress at the support points.

Figure 3A:
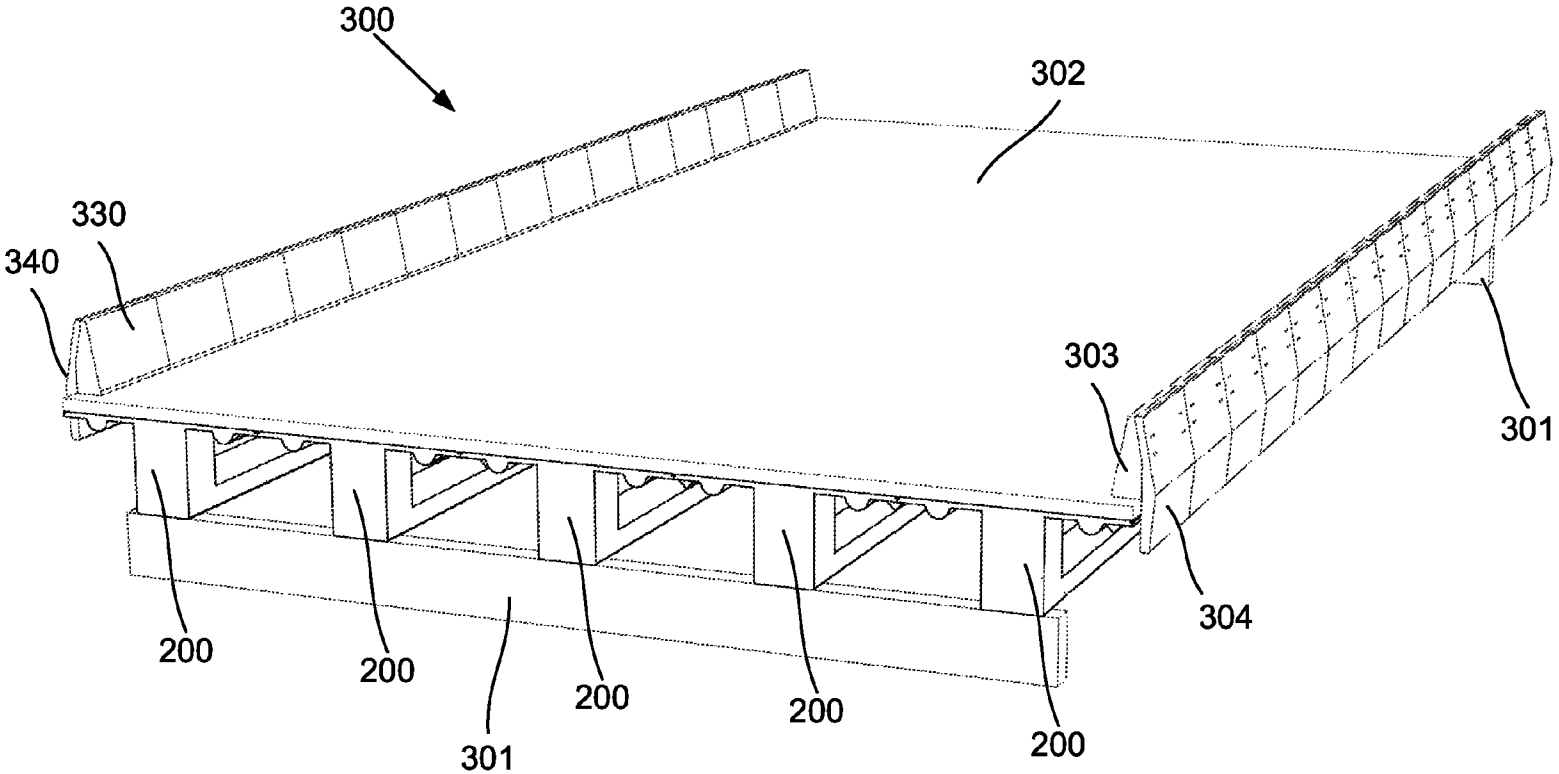
FIG. 3A is a schematic top perspective view of an example of a bridge structure formed using the precast concrete beams of FIG. 2A.
Figure 3B:
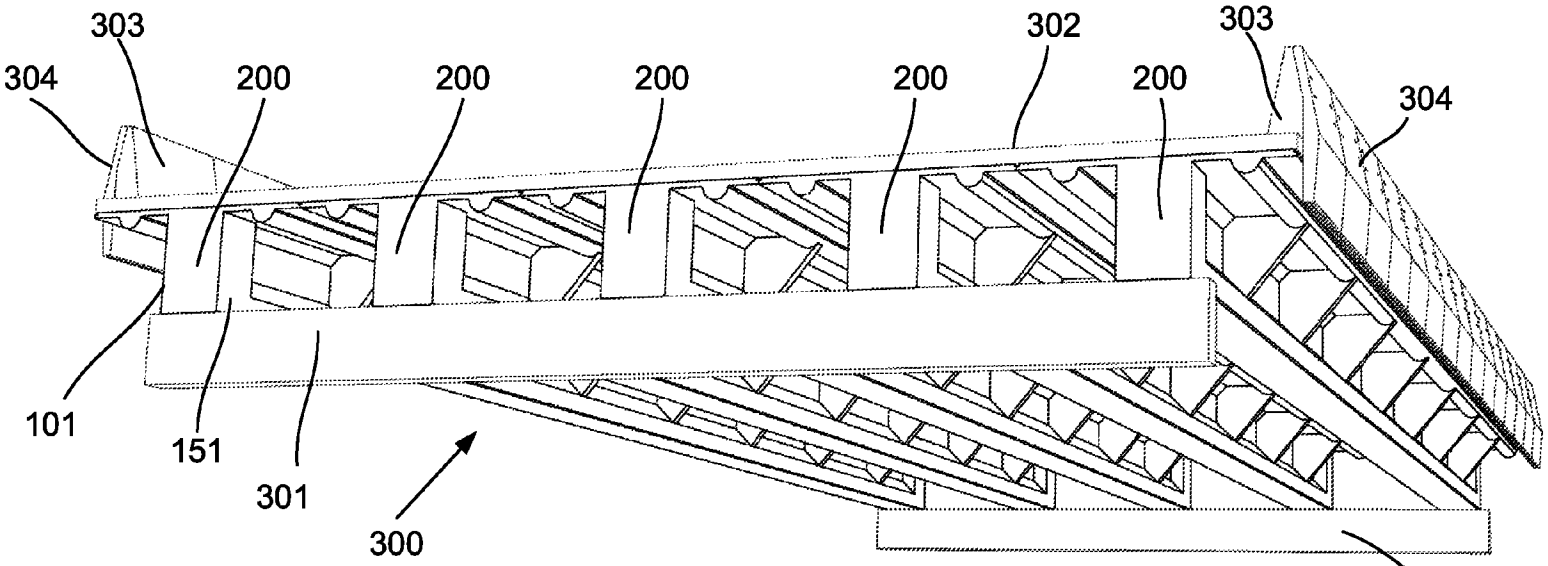
FIG. 3B is a schematic bottom perspective view of the bridge structure of FIG. 3A.
Figure 3C:
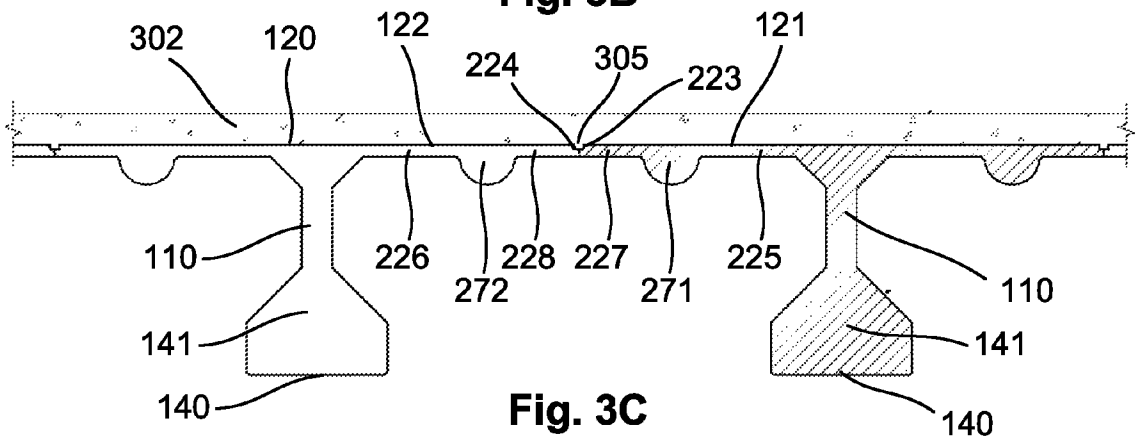
FIG. 3C is a schematic cross section view of a portion of the bridge structure of FIG. 3A.

Closer detail of a connection between adjacent beams 200 can be seen in FIG. 3C. In particular, the edges 223, 224 of the adjacent beams are abutted together, and grooves defined on the structure engaging surface 120 at the edges 223, 224 define a channel 305, into which topping concrete used to form the deck slab 302 will enter to form an effective shear key structure for providing improved lateral stability to the bridge structure 300.

It will be noted that there is no need to provide additional structure for connecting the beams 200 together laterally, with the only points of contact being the abutting edges 223, 224. In particular, it will be noted that the diaphragms or adjacent beams 200 do not make contact and are provided purely to support the flanges 121, 122.

When the beam 200 is used to construct a bridge structure 300, as per FIGS. 3A to 3C, the outer flange portions 227, 228 support the bridge deck on the outside of the secondary beams 271, 272. The entire width of the bridge deck is supported by the precast beam 200, unlike the conventional open-flange Super-Tee beams which require the placement of sacrificial formwork over the recess. The width of the outer flange portions 227, 228 extending outwardly from the secondary beams 271, 272 and diaphragms 131, 132 can be easily adjusted to suit the bridge geometry.

In some examples, the beam 200 will be sized based on the intended application, such as use in constructing a bridge structure as discussed above. Accordingly, the spacing S between the diaphragms may be selected so that loads expected to be applied to the deck slab 302 (including the weight of the deck slab 302 and any externally applied loading) will be transmitted to the web 110 via the diaphragms 131, 132.

The sizing of the beam 200 may take into account the fact that the structure engaging surface 120 is configured to engage a deck slab 302 and may thus consider the effective thicknesses of the flanges 121, 122 and the deck slab 302, treating these as a composite structure. It will be appreciated that this may take advantage of Finite Element Analysis techniques or the like, to simulate the structural performance of the bridge structure 300.

Figure 4A:
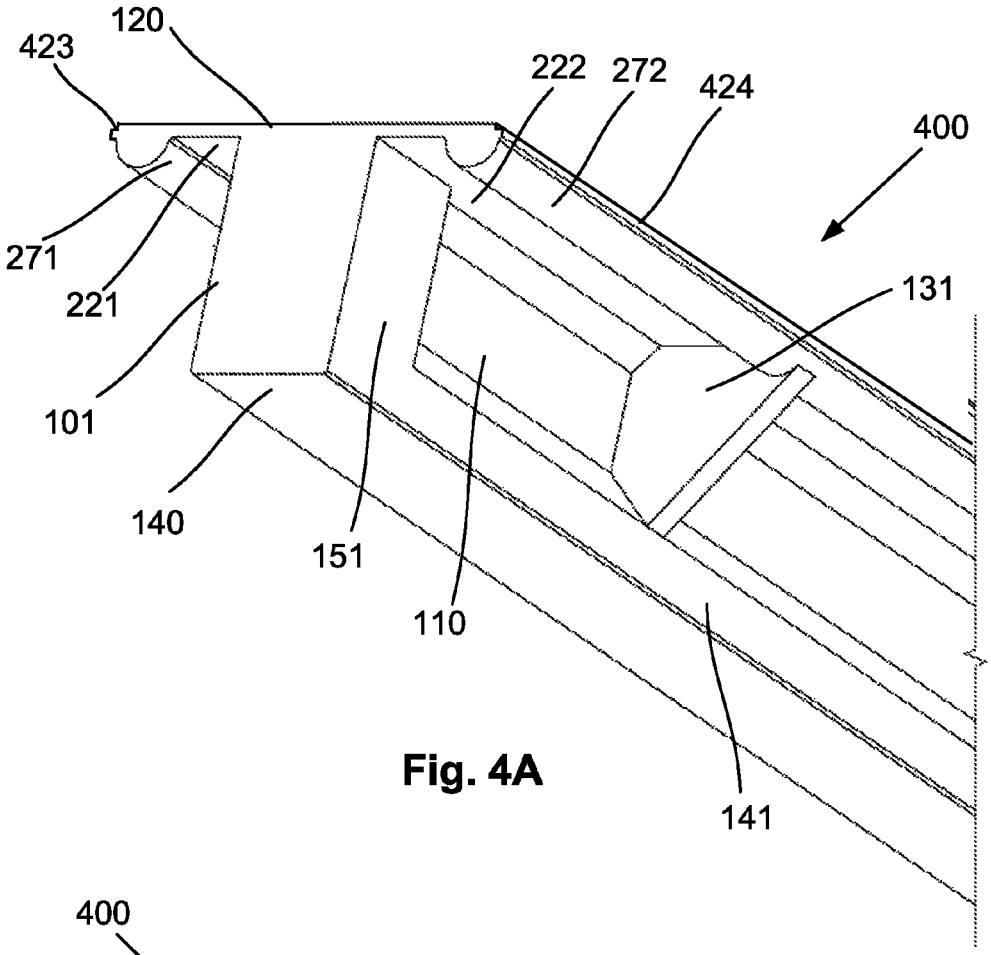
FIG. 4A is a schematic perspective view of an end portion of an example of a modified version of the precast concrete beam of FIG. 2A.

A further example of a beam 400 will now be described with regard to FIGS. 4A and 4B. The beam 400 is generally the same as the earlier example beam 200, but in this case the outer flange portions 227, 228 are not provided and each secondary beams 271, 272 is located at an outer edge of the flange. Thus the flanges 121, 122 terminate at the secondary beams 271, 272.

This arrangement may be desirable when a longer span is required, although this will of course require a greater number of beams 400 to be provided across the width of the bridge in view of the reduced width of the beam 400.

Figure 4B:
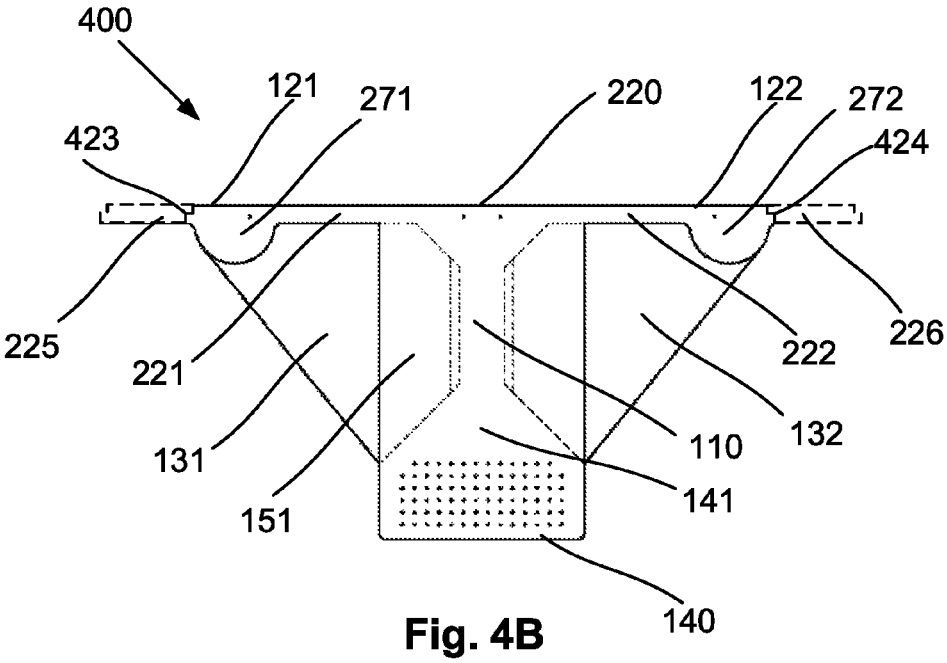
FIG. 4B is a schematic end view of the modified version of the precast concrete beam of FIG. 4A.

It will be appreciated that the beam 400 may be provided as a modified form of the beam 200, by removing the outer flange portions 227, 228 as indicated in FIG. 4B. In one example, standardised beams may be produced in accordance with the example beam 200, and then modified by cutting off the outer flange portions 227, 228 to form the beam 400. Alternatively, the formwork used to case the beam 200 may be modified so that concrete is not cast into the regions for forming the outer flange portions 227, 228, so that the beam 400 is cast instead of the wider beam 200.

It will be understood that the use of a standardised beam and/or standardised formwork to provide two different beam configurations can carry significant manufacturing and logistical efficiencies, particularly compared to Super-Tee beams for which completely different formwork will be required to manufacture different sizes.

Figure 5A:
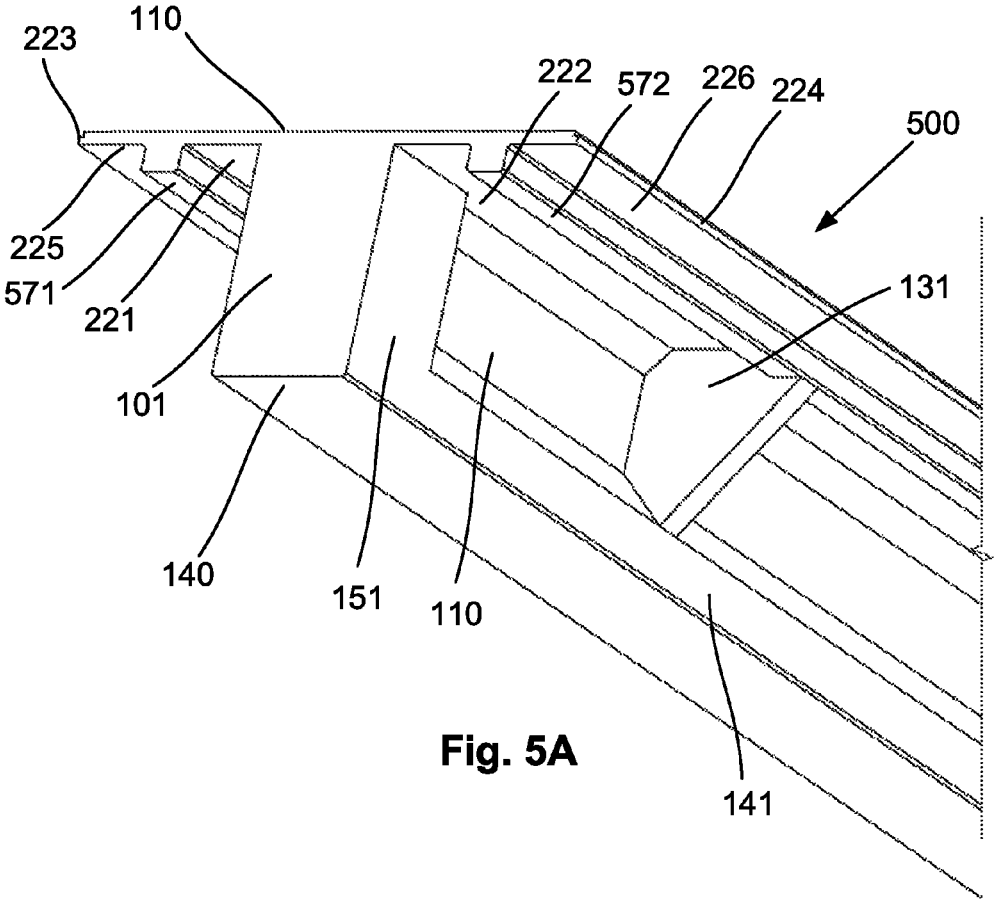
FIG. 5A is a schematic perspective view of an end portion of a third example of a precast concrete beam.
Figure 5B:
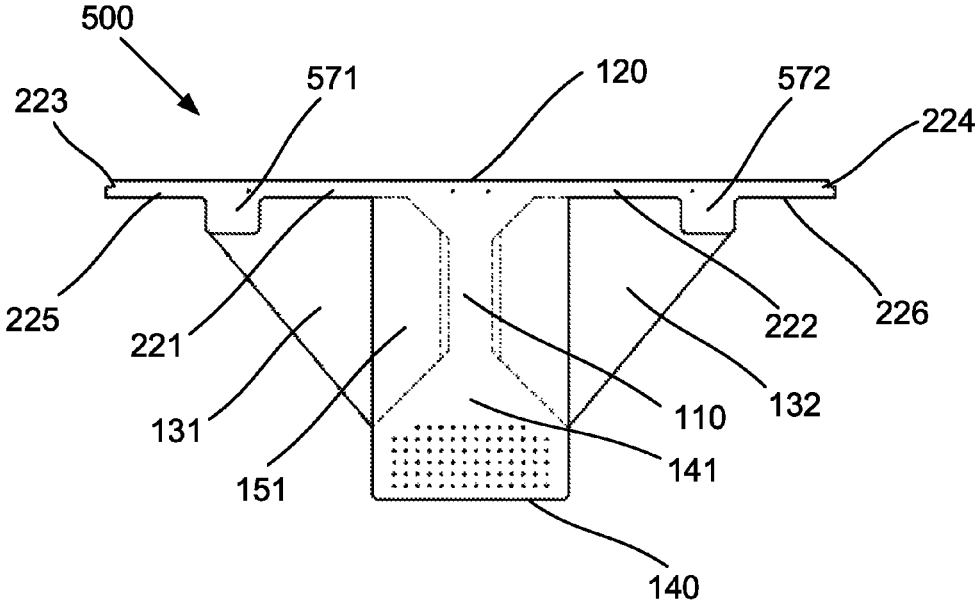
FIG. 5B is a schematic end view of the precast concrete beam of FIG. 5A.

Whilst the examples of FIGS. 2A to 2G, 3A to 3C, 4A and 4B each show secondary beams 271, 272 with a semi-circular shaped cross section profile, it will be appreciated that different shapes may be used depending on requirements. For example, FIGS. 5A and 5B show an example of a beam 500 having secondary beams 571, 572 with a rectangular shaped cross section profile. In other examples, the secondary beams 271, 272 may be provided with cross section profiles of any other shape, including square, triangular, or rounded shapes.

The particular shape and sizing of the secondary beams, along with all of the other features of the beams, will be determined in view of the particular structural requirements of the beam, along with other factors such as the ability to practically cast the beam and transport the beam with minimal risk of damage to the features.

In some bridge construction applications, it may be desirable to have provisions for routing services, using services pipes, conduits or the like, along the precast concrete beams. In some examples, services may be supported with penetrations made within the diaphragms 131, 132.

Figure 6:
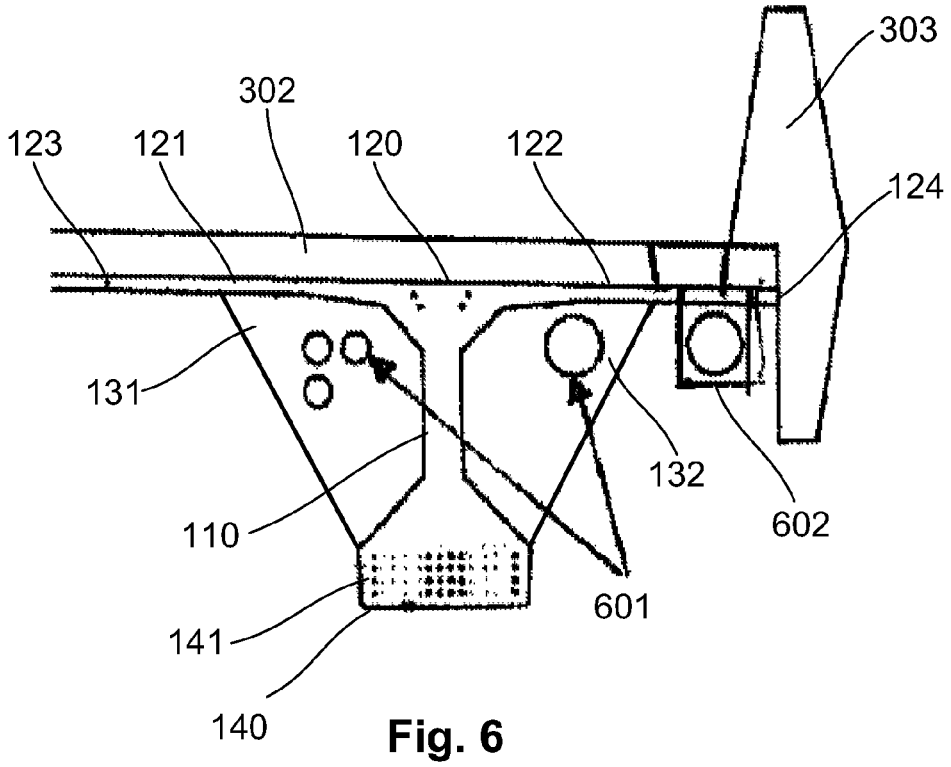
FIG. 6 is a schematic cross section view of an example of a portion of a bridge structure using a precast concrete beam including service holes.

As shown in FIG. 6, an arrangement of one or more services holes 601 may be defined in the diaphragms 131, 132 to allow services to run through the diaphragms 131, 132. The service holes 601 may be conveniently formed during the casting process using blockouts to form voids in the cast concrete structure. It will be appreciated that any reinforcements provided within the diaphragms 131, 132 will be located around the service holes 601 in these examples.

By providing service holes 601 through the diaphragms 131, 132, this can allow services pipes or the like to be easily held under a bridge constructed with the precast concrete beams without requiring additional support arrangements for accommodating services.

In bridge construction, it will often be desirable so that at least some portions of the bridge deck slab 302 include superelevation, which is a lateral slope resulting in a difference in elevation between the sides of the deck slab 302. Superelevation can be useful for allowing for water runoff and may also be employed for curved bridges to for vehicles to manoeuvre through the curve at higher speeds.

Figure 7:
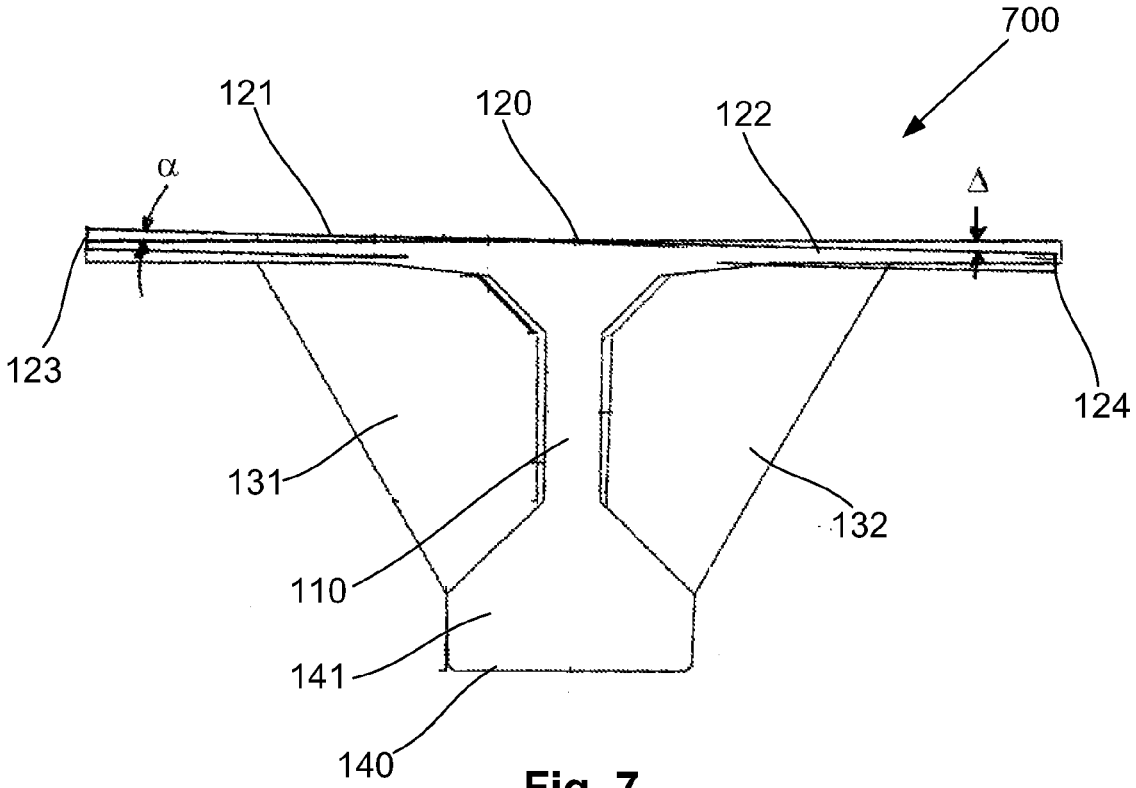
FIG. 7 is a schematic cross section view of a fourth example of a precast concrete beam.

An example of a precast concrete beam 700 including modifications to account for superelevation is shown in FIG. 7. It will be appreciated that this example of the precast concrete beam 700 includes generally similar features as the original example as shown in FIGS. 1A to 1G, but includes sloped flanges 121, 122 to account for the lateral slope for providing a desired amount of superelevation across the surface engaging surface 120, upon which the deck slab 302 will ultimately be formed. The flanges 121, 122 extend laterally from the web 110 at an angle to define a sloped structure engaging surface 120.

In FIG. 7, the sloped flanges 121, 122 are superimposed on a flange arrangement without any slope to allow the slope angle $\alpha$ of the sloped flanges 121, 122 and the difference $\Delta$ in elevation across one of the flanges 122 to be more easily visualised. In this case, the sloped flanges 121, 122 are rotated at a 1.72 degree slope angle $\alpha$ from a plane generally perpendicular to the web, which unsloped flanges would typically lie on. This defines a 3% superelevation. However, it will be understood that the particular slope angle $\alpha$ will usually be selected depending on bridge requirements which can vary case by case.

It will be appreciated that the sloped flanges 121, 122 help to accommodate the superelevation of a bridge deck slab 302 without requiring a step change in the deck slab 302 thickness across the flanges 121, 122, which would otherwise be required if unsloped flanges were used. The slope angle $\alpha$ of the sloped flanges 121, 122 can be selected to closely match the desired superelevation. This can reduce or minimise the volume of concrete in the in-situ deck slab 302. The mould used for casting the precast concrete beam 700 may be configured to account for superelevation and allow the slope angle α to be varied.

As discussed above, the precast concrete beams may include internal reinforcement members. The reinforcement members are typically provided in a suitable arrangement in the mould prior to the concrete casting process. In some embodiments, longitudinally extending internal reinforcement members, usually prestressed prior to casting, may be sufficient, although in other embodiments, it may be desirable to also provide laterally extending internal reinforcement members at selected locations along the length of the beam.

Figure 8C:
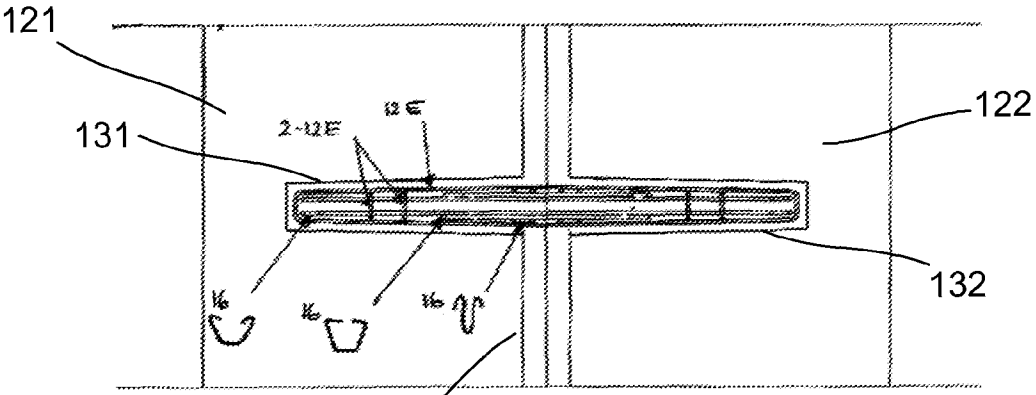
FIGS. 8A to 8C are schematic cross section views of a precast concrete beam showing examples of internal reinforcements.
Figure 8B:
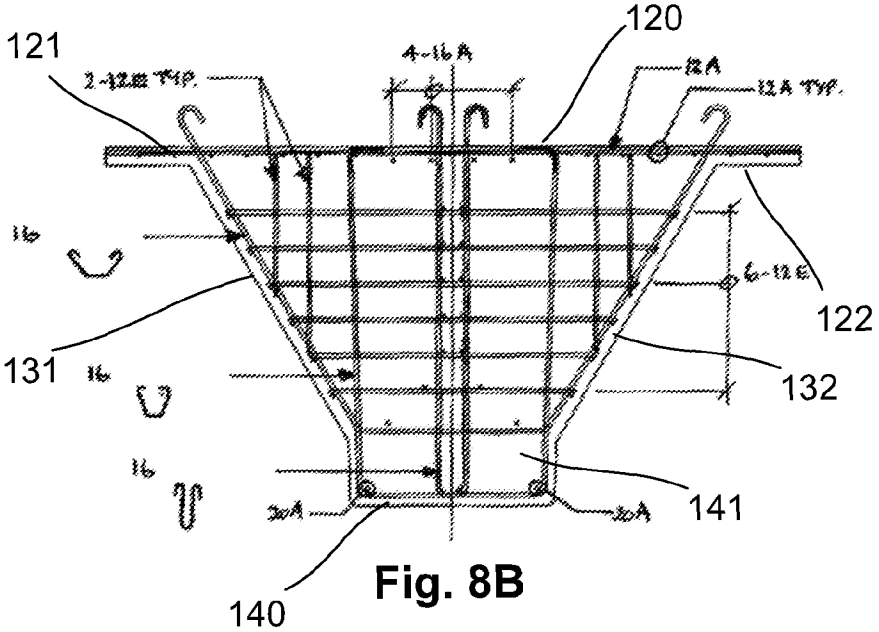
Figure 8A:
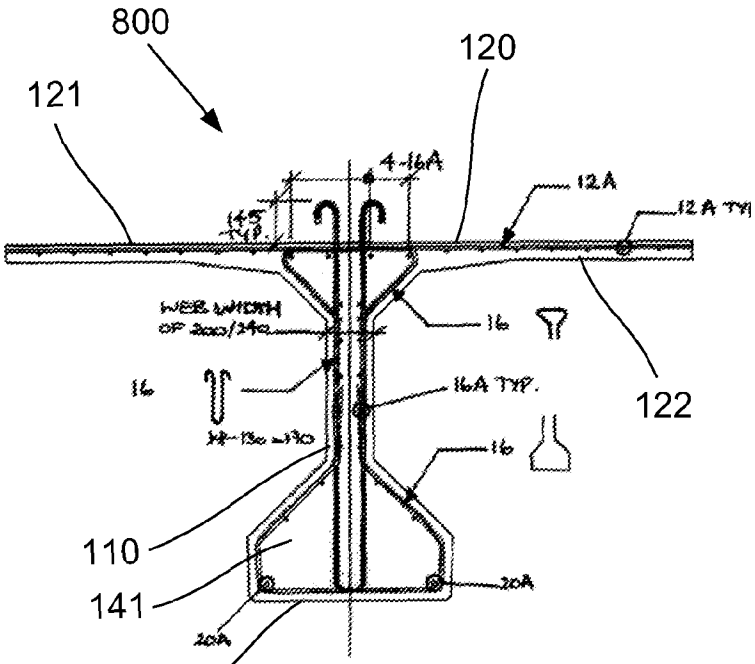

FIGS. 8A to 8C provide indicative examples of arrangements of laterally extending reinforcement members in an example of a precast concrete beam 800.

FIG. 8A shows a cross section view at a longitudinal position located between diaphragms 131, 132, where reinforcement members are arranged inside the web 110, the flanges 121, 122, the bulb 141 and a chamfered region between the web 110 and the flanges 121, 122. Representative reinforcement member shapes are indicated, but it will be appreciated that different types of reinforcement members with different arrangements may be used whilst providing a similar degree of reinforcement.

FIG. 8B shows a cross section view at a position coinciding with the diaphragms 131, 132. In this case, the internal reinforcement members are also arranged across the diaphragms 131, 132 to thereby provide additional reinforcement in those regions. As can be seen, the arrangement of internal reinforcement members results in a pattern of generally horizontally and vertically oriented lengths of reinforcement across the diaphragms 131, 132 and the web 110. As seen in FIG. 8C which shows a cross section inside the diaphragms 131, 132, the internal reinforcement members within the diaphragms 131, 132 may also be spaced apart longitudinally to not only allow multiple internal reinforcement members to be accommodated but to also provide for enhanced out-of-plane stiffness within the diaphragms 131, 132.

As shown in FIGS. 8A to 8C, some of the reinforcement members may be configured so that portions of the reinforcement members protrude above the surface engaging surface 120 when the beam 800 is cast. These allow for handling of the beam 800 but can also help to ensure a rigid connection to a deck slab when this is poured onto the surface engaging surface 120 to form a bridge construction.

Figure 9A:
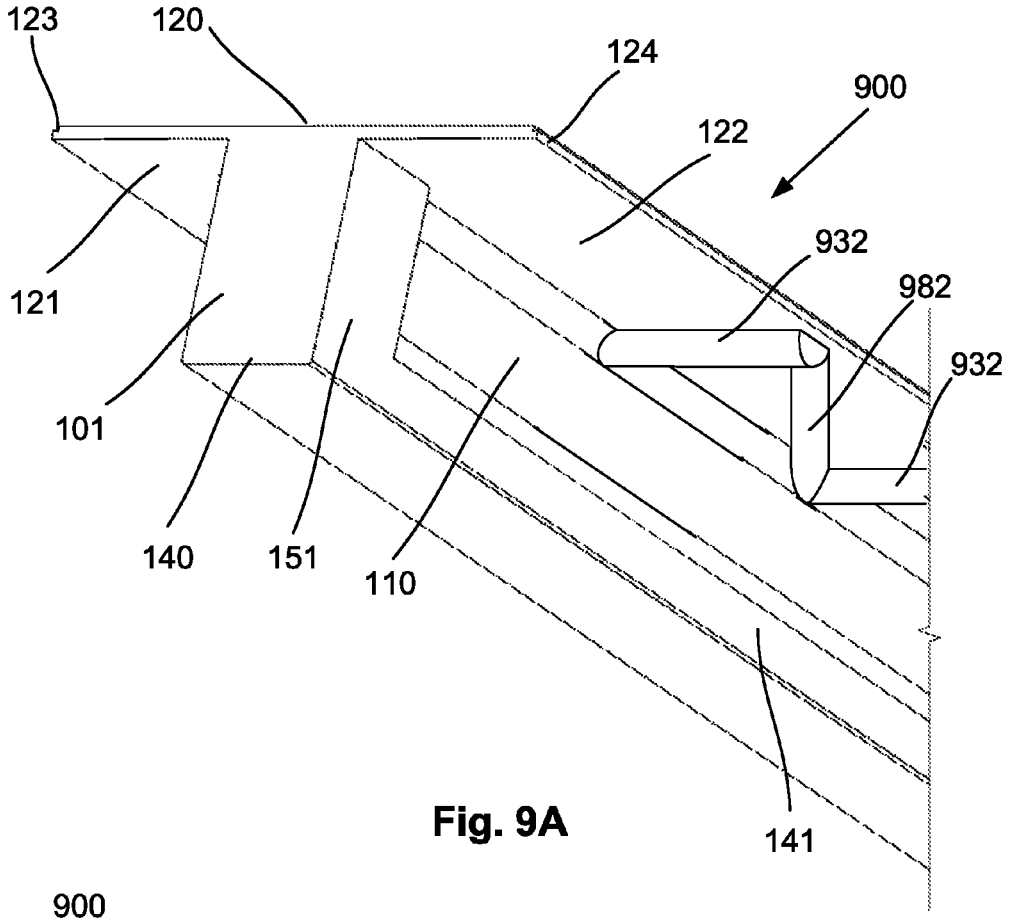
FIG. 9A is a schematic perspective view of an end portion of a sixth example of a precast concrete beam.
Figure 9B:
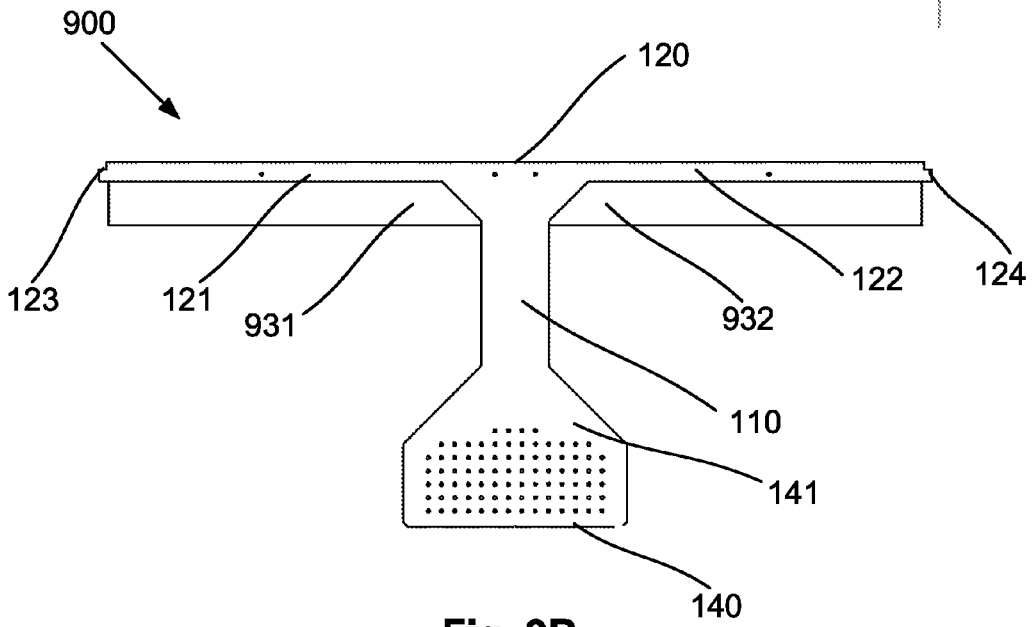
FIG. 9B is a schematic cross section view of the precast concrete beam of FIG. 9A.
Figure 9C:
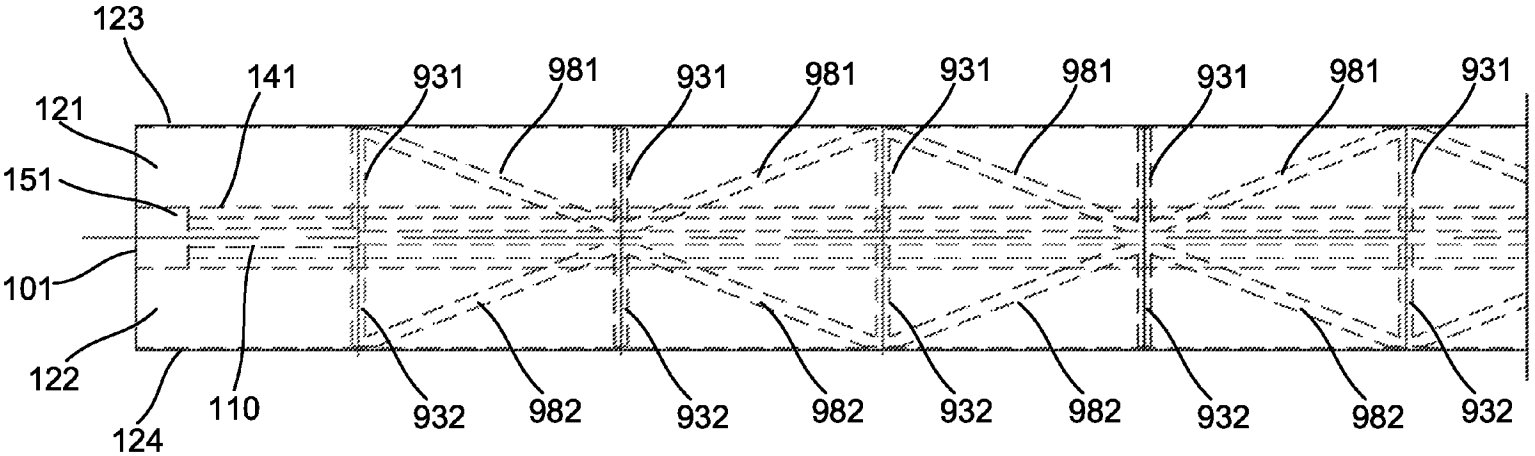
FIG. 9C is a schematic top view of the precast concrete beam of FIG. 9A.
Figure 9D:
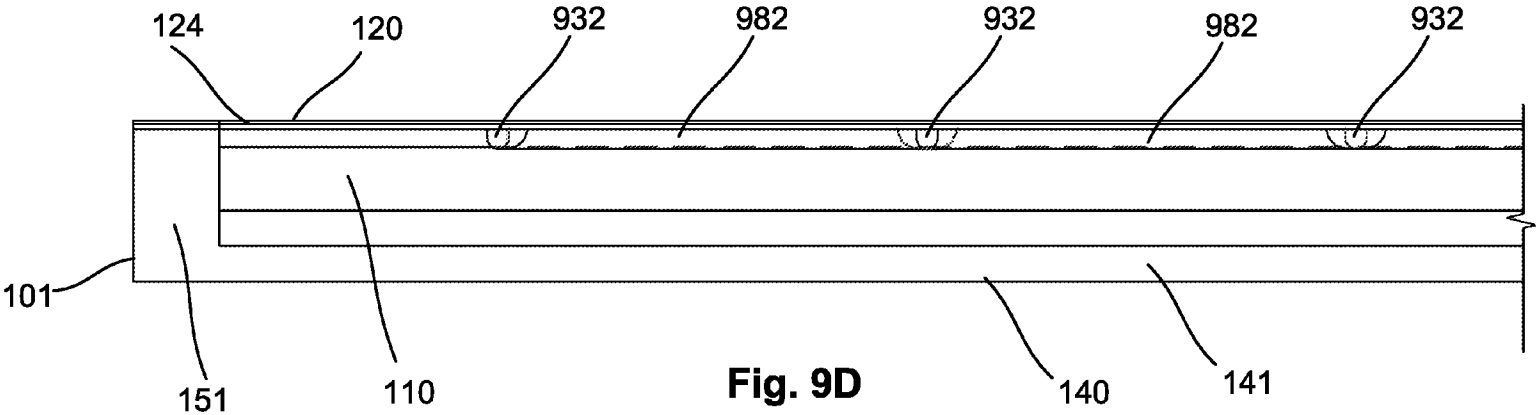
FIG. 9D is a schematic side view of the end portion of the precast concrete beam of FIG. 9A.

Another example of a precast concrete beam 900 will now be described with regard to FIGS. 9A and 9D, to illustrate an alternative diaphragm arrangement.

Accordingly, as per the previous examples, the beam 900 includes a substantially planar web 110 extending longitudinally between ends 101, 102 of the beam 900. A pair of flanges 121, 122 are formed integrally with the web 110, where each flange 121, 122 extends laterally from an elongate edge of the web 110 and extends longitudinally between the ends 101, 102 of the beam 900 so as to define a structure engaging surface 120 of the beam. The beam 900 further includes a plurality of diaphragms 931, 932 formed integrally with the web 110 and the flanges 121, 122. However, it will be seen that these diaphragms 931, 932 have a different structural arrangement compared to the diaphragms 131, 132 of previous examples, in that the diaphragms 931, 932 are generally provided in the form of laterally extending members located underneath the flanges 121, 122. Nevertheless, each diaphragm 931, 932 spans laterally between a side of the web 110 and one of the flanges 121, 122, and the diaphragms 931, 932 are spaced apart along the beam 900 to thereby support the flanges 121, 122, as in the previous examples.

As can be seen in FIGS. 9A to 9D, the diaphragms 931, 932 are relatively shallow in nature compared to previous examples and illustrate a configuration where the diaphragms 931, 932 have been significantly reduced in size whilst still providing similar advantages as discussed above. It will be appreciated that, as per previous examples, the diaphragms 931, 932 will support the flanges 121, 122 such that loads applied to the flanges 121, 122 can be transferred into the central web 110 via the diaphragms 931, 932, thus allowing for relatively thinner and/or wider flanges 121, 122 than would be possible without the use of the diaphragms 931, 932.

In this example, the beam 900 also includes diagonal beams 982 which extend diagonally relative to the length of the beam 900. As can be seen in FIGS. 9A and 9C, the diagonal beams 982 each extend between a base of a first diaphragm 932 at its connection with the web 110 and an end of a second adjacent diaphragm 932 where it terminates at or near an edge 124 of the respective flange 122.

It will be appreciated that these diagonal beams 982 may provide support between the diaphragms 931, 932 similar to that provided by the secondary beams 271, 272 in some of the previous examples. Furthermore, the diagonal orientation of the diagonal beams 982 will mean that they also provide some lateral support for the flanges 121, 122 in additional to that provided by the main diaphragms 931, 932.

Thus, the beam 900 of FIGS. 9A to 9D represents a useful alternative arrangement which can allow the overall size and protrusion presented by the diaphragms 931, 932 to be significantly reduced, allowing for more flexible deployment in bridge structures and potential weight savings, particularly for beams requiring less width across the flanges 121, 122.

In any event, it will be appreciated that precast concrete beams formed in accordance with the above described examples can provide useful benefits over other precast concrete beams conventionally used in bridge construction, in view of the ability to significantly expand the width of the beams due to the improved support provided by the diaphragms. Optional features such as the secondary beams provide even further opportunity to increase the width. Accordingly, the beams described above can be used in reduced numbers compared to conventional beams whilst providing sufficient strength and stability over the same spans.

The above discussed examples provide a structure engaging surface 120 upon which a deck slab or the like may be poured to form a complete bridge structure. However, in another aspect, precast concrete beams may be provided which include an integral slab portion which can allow a bridge structure to be constructed without requiring a structural deck slab. An example of a precast concrete beam 1000 of this type will now be described with reference to the example of FIGS. 10A and 10B, and examples illustrating the use of such beams 1000 in constructing a bridge structure will then be described with reference to FIGS. 10C and 10D.

In this aspect, the precast concrete beam 1000 broadly includes a central portion extending longitudinally between ends 101, 102 of the beam 1000. The central portion 1010 may include a substantially planar web 110 with any of the further optional features as discussed in the previous examples, although as will be described in due course with regard to FIG. 12, different configurations of the central portion 1010 may also be used in conjunction with this aspect.

The beam 100 also includes a pair of flanges 121, 122, each flange 121, 122 being formed integrally with the central portion 1010. Each flange 121, 122 extends laterally from a respective elongate edge of the central portion 1010 and extends longitudinally between the ends 101, 102 of the beam 1000.

As mentioned above, in this case the beam 1000 includes an integral slab portion 1020, which is formed integrally with the flanges 121, 122. The integral slab portion 1020 defines a substantially planar slab surface 1021 of the beam 1000. This integral slab portion 1020 forms a segment of an effective deck slab surface when beams 1000 are used in constructing a bridge structure.

Figure 10A:
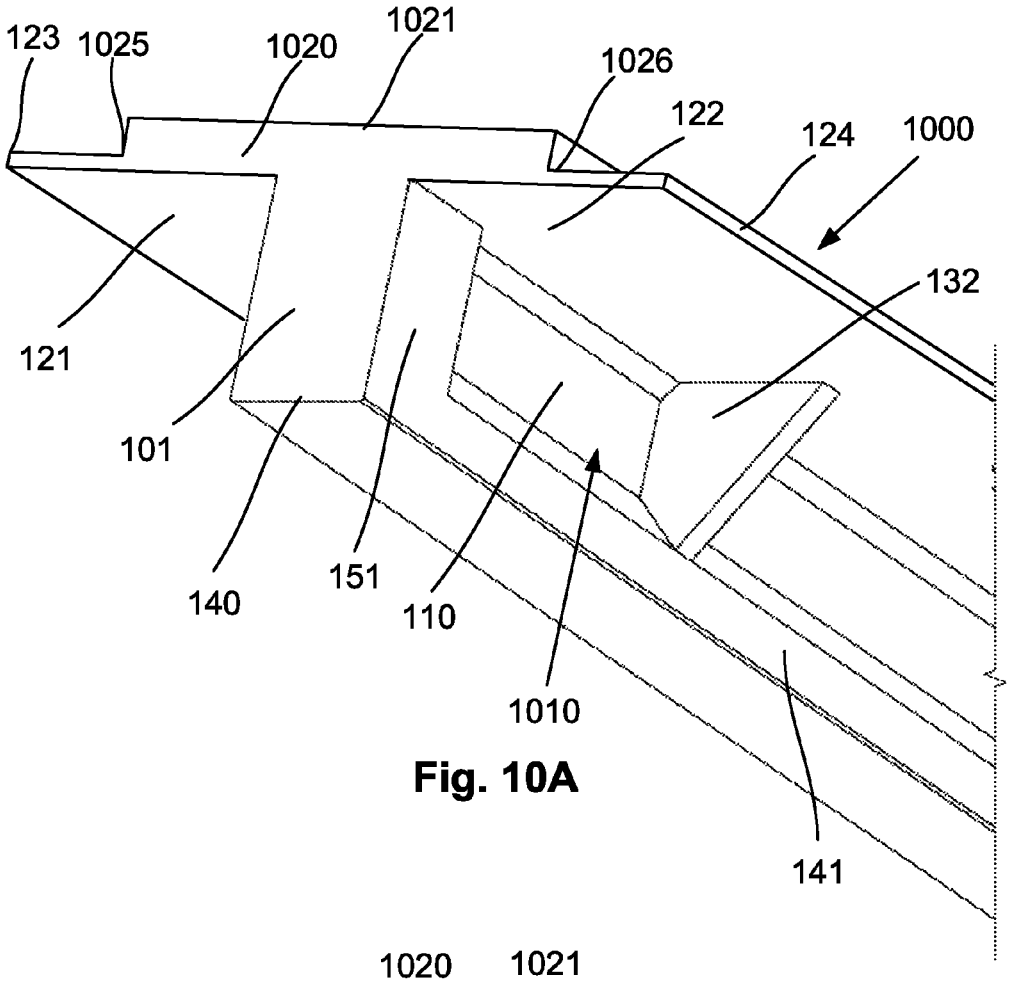
FIG. 10A is a schematic perspective view of an end portion of a seventh example of a precast concrete beam.
Figure 10B:
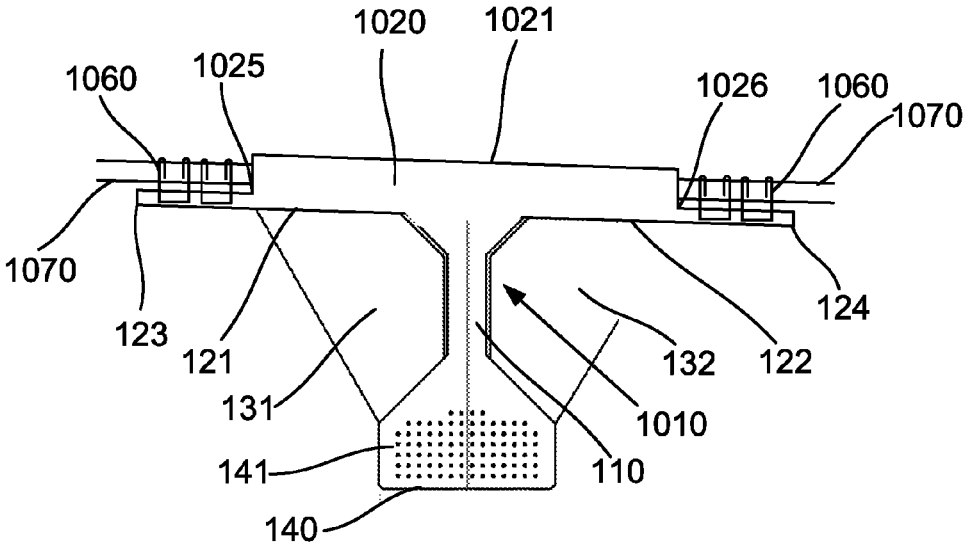
FIG. 10B is a schematic cross section view of the precast concrete beam of FIG. 10A.
Figure 10C:
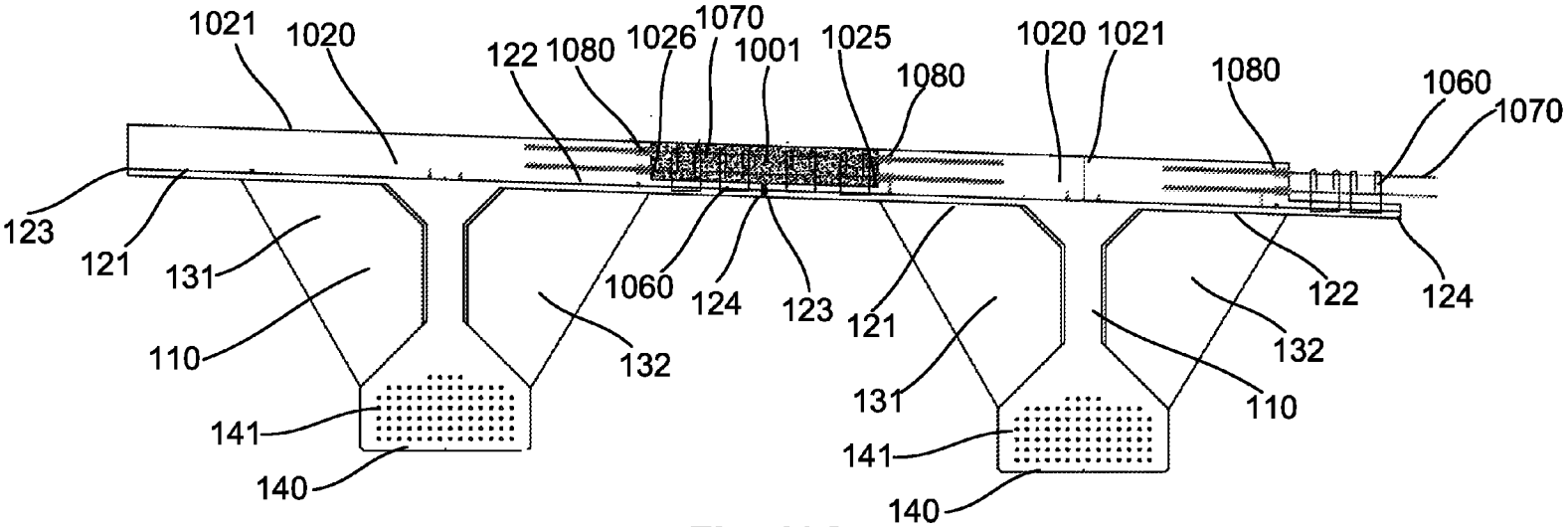
FIG. 10C is a schematic cross section view of an example of a portion of a bridge structure using the precast concrete beams of FIG. 10A.

Furthermore, the beam includes a recessed region 1025, 1026 formed along an outer edge of the integral slab portion 1020, to thereby allow adjacent beams 1000 to be joined by abutting respective edges 123, 124 of the adjacent beams 1000 so that the respective recessed regions 1025, 1026 form an effective joint recess and forming a concrete infill 1001 in the effective joint recess, as illustrated in FIG. 10C.

It will be appreciated that this arrangement can be used to remove the need for pouring a deck slab onto the beams when constructing a suitable bridge structure, which can allow for improvements in the speed of construction.

Although diaphragms 131, 132 are shown in this example, it should be understood that these may be omitted in some embodiments of this aspect, because the integral slab portion 1020 will typically be significantly thicker than the flanges 121, 122 in previous examples, such that these may be supported by cantilevering from the central portion without requiring additional support to be provided by the diaphragms 131, 132. In other words, alternative forms of the beam 1000 may be provided without the diaphragms 131, 132. Nevertheless, in some circumstances diaphragms 131, 132 having any of the above described features may still be desirable in optimizing the weight and strength characteristics of the beam 1000.

The integral slab portion 1020 will preferably be formed at least in part from thickened regions of the flanges 121, 122. As shown in FIGS. 10A and 10B, the integral slab portion 1020 in this example is effectively provided as a wide strip of increased thickness extending along the beam 1000 between its edges 123, 124.

The integral slab portion 1020 may be formed such that the slab surface 1021 is aligned with a lateral extension direction of the flanges 121, 122 relative to the central portion 1010. In other words, the slab surface 1021 may be parallel to and offset from the flanges 121, 122. Thus, the flanges 121, 122 and the slab surface may extend at the same or substantially similar angles.

The flanges 121, 122 may extend perpendicularly from the central portion to define a substantially horizontal slab surface 1021. However, as discussed above with regard to FIG. 7, in some circumstances it will be desirable to provide for superelevation by having the flanges 121, 122 extend at an angle, and similar arrangements may be applied to this aspect.

In this example and in many other preferred implementations, the central portion 1010 may be substantially symmetrical about a longitudinally extending symmetry plane. For example, the symmetry plane in this example will run centrally through the planar web 110. This symmetry plane will typically be in an upright or vertical orientation when a bridge is constructed using the beams 1000. The flanges 121, 122 may thus extend laterally from the central portion 101 at an angle relative to the symmetry plane. In preferred embodiments accounting for superelevation, the slab surface 1021 may thus be sloped relative to the symmetry plane.

It will be appreciated that the integral slab portion 1020 can be particularly useful in constructing bridges with lateral superelevation, as the use of a precast concrete beam 1000 including an already sloped slab surface 1021 can remove the need to pour broad expanses of deck slab concrete that would otherwise need to have step changes in thickness at junctions between beams with horizontal structure engaging surfaces, and would need to be finished with a sloped deck slab surface.

The beam 1000 may also include provisions for reinforcing the concrete infill for joining adjacent beams 1000 and ensuring a solid joint between the beams 1000. For example, the beam 1000 may include reinforcement members 1060 embedded into the flanges 121, 122 and protruding into the recessed portions 1025, 1026, such that the concrete infill 1001 is reinforced by the reinforcement members 1060 when adjacent beams 1000 are joined, as seen in FIG. 10C.

The beam may also include reinforcement couplers 1080 embedded into the integral slab portion 1020 for supporting reinforcement bars 1070 protruding laterally across the recessed portions 1025, 1026 such that the concrete infill 1001 is reinforced by the reinforcement bars 1070 when adjacent beams 1000 are joined. The reinforcement bars 1070 may extend laterally beyond an edge 123, 124 of the beam to thereby protrude into an adjacent recessed portion 1025, 1026 when adjacent beams 1000 are joined.

Figure 10D:
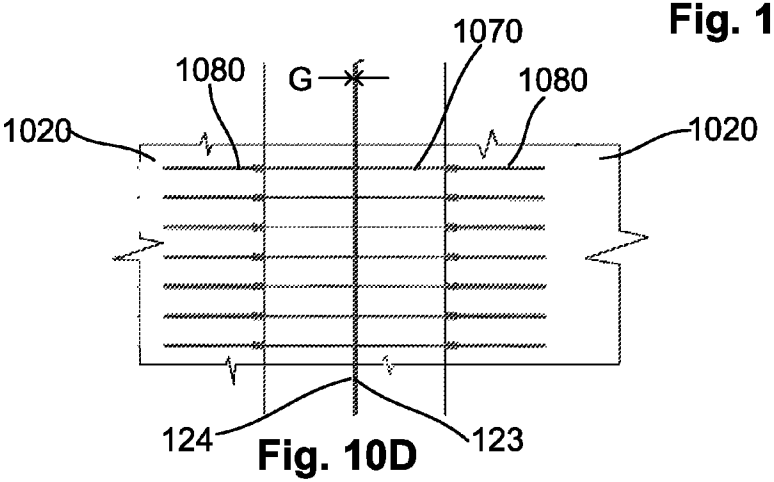
FIG. 10D is a schematic top view of a portion of a joint between the precast concrete beams in the bridge structure of FIG. 8B.

FIGS. 10C and 10D show an example in which the precast concrete beams 1000 are used in the construction of a portion of a bridge structure having a 3% superelevation. In this example, a deck slab is not formed by pouring of concrete on upper surface engaging surfaces of the adjacent precast concrete beams 1000. Rather, the integral slab portions 1020 which are formed as thickened regions of the flanges 121, 122 of each beam 1000 make up segments of an effective deck slab. The concrete infills 1001 are provided at the interfaces between each adjacent integral slab portions 1020 by pouring concrete into adjoining recessed regions 1025, 1026 along edges of the integral slab portions 1020.

In this example, the integral slab portions 1020 include reinforcement couplers 1080 adjacent to the recessed regions 1025, 1026. These reinforcement couplers 1080 are configured to support reinforcement bars 1070 which extend from the integral slab portions 1020 into the recessed regions 1025, 1026. Accordingly, the reinforcement bars 1070 provide reinforcement for the concrete infills 1001 when these are poured, helping to form a rigid joint between the beams.

As mentioned previously, the reinforcement bars 1070 will preferably extend beyond the respective edge 123, 124. The reinforcement bars 1070 of one beam 1000 may thus overlap into the recessed region 1025, 1026 of an adjacent beam 1000, which can further assist in providing the rigid joint between adjacent beams 1000 when the concrete infills 1001 are poured.

As can be seen in FIG. 10C, the reinforcement couplers 1080 and the supported reinforcement bars 1070 are regularly spaced along the edge of the beams 1000. In practice it may be desirable to position the reinforcement couplers 1080 and in turn the reinforcement bars 1070 on either side of the beam 1000 so that these are staggered and do not interfere when beams 1000 are positioned adjacent to one another. A nominal gap G may remain between the edges 123, 124 of adjacent beams 1000.

The reinforcement members 1060 are embedded into the flanges 121, 122 of the precast concrete beams 1000 near the respective edges 123, 124 and protrude into the recessed regions 1025, 1026 such that, when poured and cured, the concrete infill 1001 will be reinforced by the reinforcement member 1060*s* and rigidly bound to the underlying beam structure.

The integral slab portions 1020 and the concrete infills 1001 will typically be finished to provide a substantially planar effective slab surface extending across the bridge structure. However, it will be appreciated that a non-structural layer of material such as asphalt or any other suitable surface covering may be provided over the effective slab surface to provide a smooth finish, consistency of appearance, and/or enhanced traction on the final bridge surface, depending on its end application. However, this non-structural layer of material will typically be significantly thinner than the structural deck slabs described in previous examples.

As discussed above, some forms of the precast concrete beams may involve the use of central portion 1010 configurations that are different to the previously described examples including the substantially planar web 110, and an illustrative example of a beam 1100 with a different central portion 1010 configuration will now be described with regard to FIGS. 11A to 11G.

In broad terms, the beam 1100 includes a central portion 1010 extending longitudinally between ends 101, 102 of the beam 1110. The beam 1100 includes a pair of flanges 121, 122, each flange 121, 122 being formed integrally with the central portion 1010, and each extending laterally from a respective elongate edge of the central portion 1010 and extending longitudinally between the ends 101, 102 of the beam 1100 so as to define a structure engaging surface 1121, 1122 of the beam 1100. The beam 1100 also includes a plurality of diaphragms 131, 132 each formed integrally with the flanges 121, 122 and the central portion 1010. Each diaphragm 131, 132 spans laterally between one of the flanges 121, 122 and a side of the central portion 1010, wherein the diaphragms 131, 132 are spaced apart along the beam 1100 to thereby support the flanges 121, 122.

It will be understood that the main difference in this example compared to other examples lies in the particular structural configuration of the central portion 1010. Otherwise, the other elements of the beam 1100 such as the flanges 121, 122 and diaphragms 131, 132 may be implemented in a similar manner as any of the previous examples, incorporating any of the above described optional features.

In this example, the central portion 1010 is provided with a similar construction as per conventional "Super-Tee" beams, having a U-shaped structure. In general terms, the central portion 1010 in this example now includes a pair of substantially planar webs 1111, 1112 extending longitudinally between the ends 101, 102 of the beam 1100, rather than a single web 110 as per earlier examples. The central portion 1010 may still include a base 140 defining a support surface of the beam 1100 and the pair of webs 1111, 1112 may be provided as a pair of opposed webs 1111, 1112 extending from the base 140.

As is the case in conventional "Super-Tee" beams, the base 140 and opposed webs 1111, 1112 may define a hollow internal volume 1101 inside the central portion 1010, which can allow for significant weight savings compared to a solid central portion 1010, whilst maintaining adequate structural strength.

In some examples, this hollow internal volume 1101 may be partitioned by one or more internal bulkheads 1102, which can be best seen in FIGS. 11C and 11D. These internal bulkheads 1102 may be formed as membranes of concrete spanning inside the hollow internal volume 1101 between the opposing webs 1111, 1112, and can provide improved structural stability for the beam 1100.

As shown in this example, it may be preferable to configure the internal bulkheads 1102 so that each of these is aligned with a pair of diaphragms 131, 132. This can provide a particularly beneficial arrangement in which an effectively continuous membrane or plate of concrete extends laterally across the beam 1100 to provide the bulkhead 1102 and the diaphragms, which can aid in providing a more rigid beam and also aid in supporting the deck slab when poured.

With regard to the deck slab, this may be poured onto the beam 1100 including a region between the surface engaging surfaces 1121, 1122 defined by the flanges 121, 122 by first providing a capping surface across the hollow internal volume 1101. This may be achieved by filling the hollow internal volume 1101 with foam, or by suspending a capping surface of any suitable material above the hollow internal volume 1101. In one example, the capping surface may be supported by the internal bulkheads 1102 and internal edges of the flanges 121, 122, but in other examples, reinforcements embedded into the beam 1100 may also be used to support the capping surface.

Figure 11A:
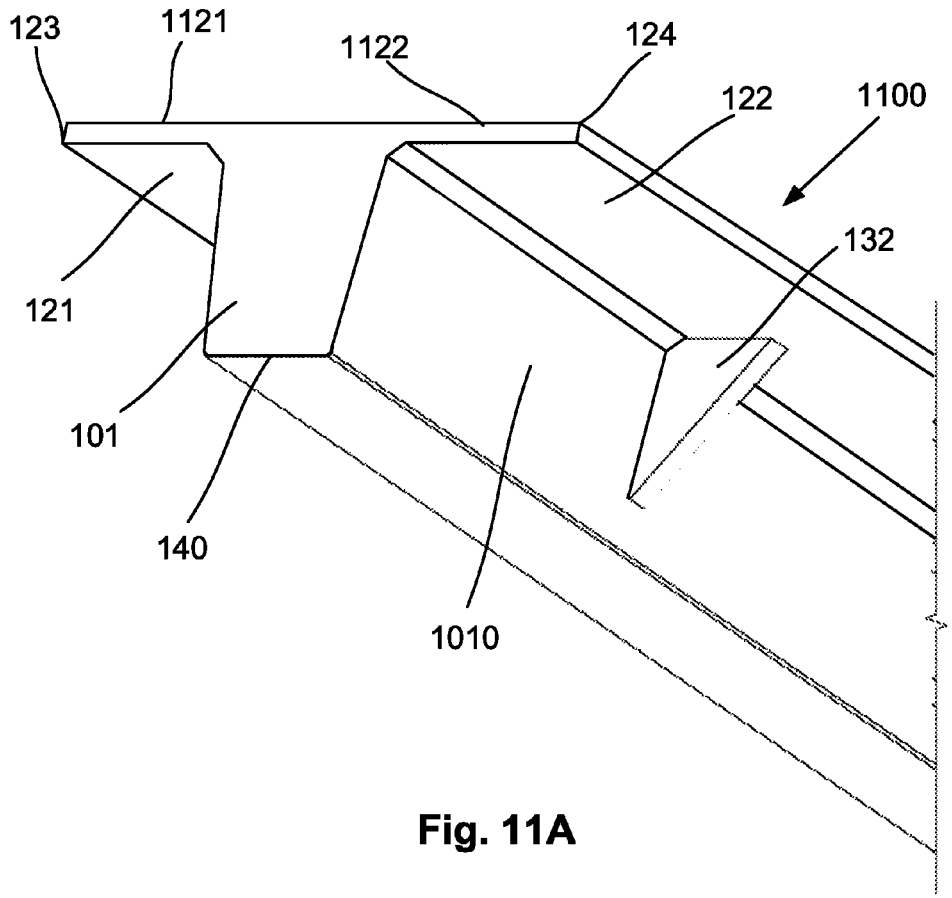
FIG. 11A is a schematic perspective view of an end portion of an eighth example of a precast concrete beam.
Figure 11B:
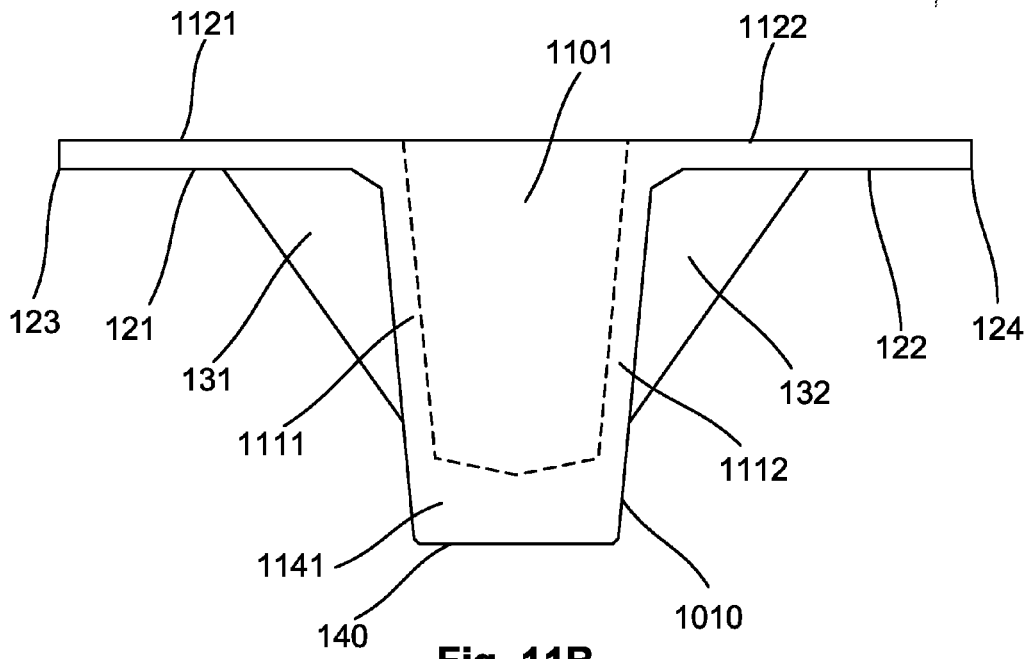
FIG. 11B is a schematic end view of the precast concrete beam of FIG. 11A.
Figure 11G:
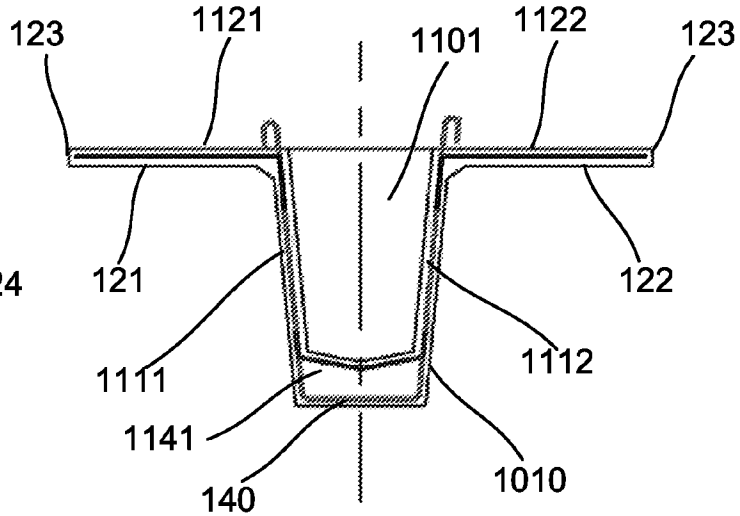
FIGS. 11F and 11G are a schematic cross section views of the precast concrete beam as shown in FIGS. 11D and 11E, showing examples of internal reinforcements; and, FIG. 12 is a schematic cross section view of an example of a portion of a bridge structure using a ninth example of a precast concrete beam.
Figure 11F:
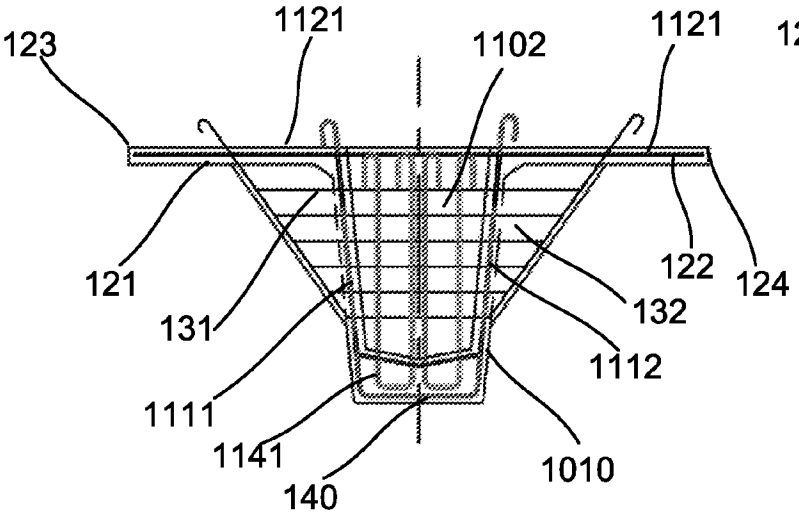

As shown in FIGS. 11F and 11G, lateral reinforcement members may be arranged at positions along the beam in a similar fashion as described for FIGS. 8A to 8C. Notably, in this example the alignment of the internal bulkheads 1102 with the diaphragms 131, 132 permits lateral reinforcement members spanning between the diaphragms 131, 132 and the opposing webs 1111, 1112 as shown in FIG. 11F, where at other longitudinal positions the lateral reinforcement members need to be arranged through the webs 1111, 1112 to preserve the internal hollow volume 1101 as shown in FIG. 11G.

Figure 12:
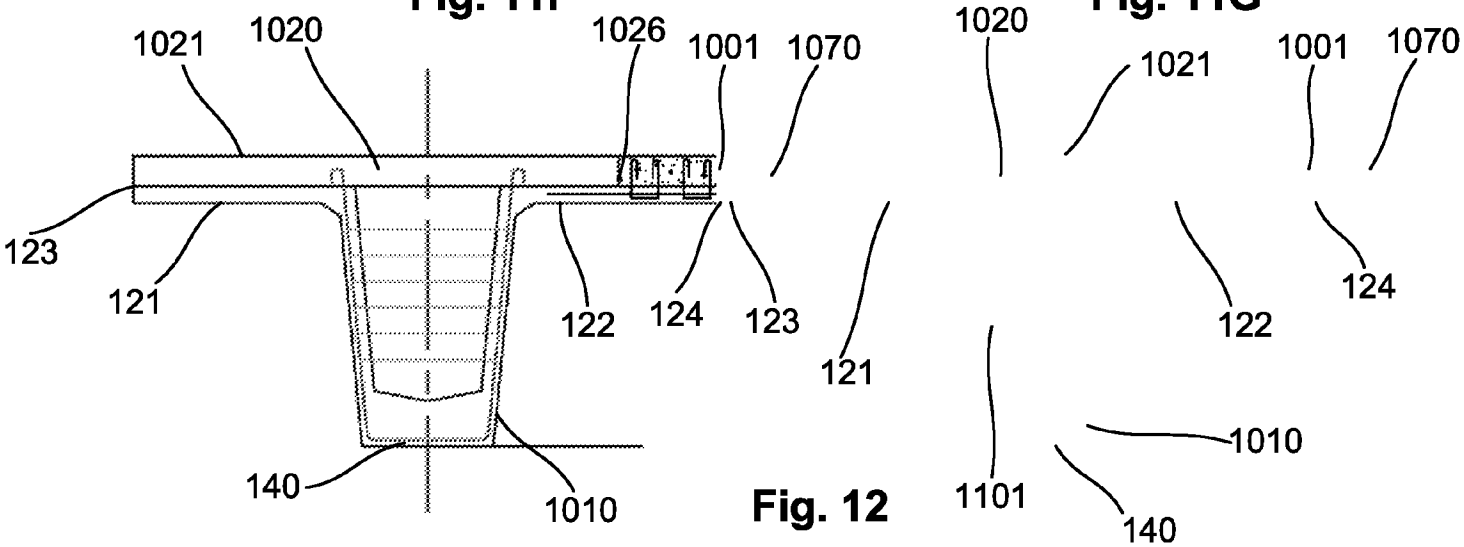

Finally, FIG. 12 shows an example of a bridge structure using beams combining the central portion 1010 as described in the immediately previous example and the integral deck slab 1020 and joining techniques described earlier.

Accordingly, it will be appreciated that any suitable form of beam may be modified to include an integral slab portion 1020 formed integrally with the flanges 121, 122, in which the integral slab portion 1020 defines a substantially planar slab surface 1021 of the beam. Diaphragms may be omitted where the integral slab portion 1020 provide adequate thickness to allow the flanges 121, 122 to be self supported by cantilevering from the central portion 1010.

In this particular example, the central portion 1010 includes a hollow internal volume 1101 that is enclosed by the integral slab portion 1020. This can be accommodated when casting the precast concrete beams, such as by filling the region to become the hollow internal volume 1101 with foam or providing any other suitable structure within the mold to restrict the ingress of concrete into the intended hollow regions.

Again, the slab surface 1021 may be sloped relative to the central portion 1010 to accommodate superelevation of the resulting bridge structure, and may additionally or alternatively include a recessed region 1025, 1026 formed along an outer edge of the integral slab portion 1020, to thereby allow adjacent beams to be joined by abutting respective outer edges 123, 124 of the adjacent beams so that the respective recessed regions form an effective joint recess and forming a concrete infill 1001 in the effective joint recess.

Accordingly, it will be appreciated that features described above with respect to different aspects may be combined to provide suitable beams depending on requirements.

In one preferred form, a precast concrete beam for use in the construction of a bridge structure, such as for a long span highway bridge or the like, may be provided in which the beam includes a substantially planar web extending longitudinally between ends of the beam, a pair of flanges formed integrally with the web, each flange extending laterally from a first elongate edge of the web and extending longitudinally between the ends of the beam so as to define a structure engaging surface of the beam, an enlarged bulb formed integrally with the web, the bulb extending along a second elongate edge of the web opposing the flanges, an array of prestressed reinforcement members being located inside the bulb, and a plurality of diaphragms formed integrally with the web and the flanges. Each diaphragm spans laterally between a side of the web and one of the flanges, each diaphragm is substantially triangle shaped and a portion of each diaphragm is connected to the bulb, and the diaphragms are spaced apart along the beam to thereby support the flanges.

It will be appreciated that embodiments in accordance with the above preferred form are depicted, for example, in FIGS. 1A to 1G, 2A to 2G, 3A to 3C, 4A and 4B, 5A and 5B, 6, 7, 8A to 8C and 10A to 10D. For convenience, reference numerals from the example of the beam 100 depicted in FIGS. 1A to 1G will be referred to in the following discussion, but it will be appreciated that this discussion will equally apply to equivalent features in the other examples. Each of the aforementioned embodiments particularly includes an enlarged bulb 141 formed integrally with the web 110 and having prestressed reinforcement members located inside the bulb 141, and triangular shaped diaphragms 131, 132 which have their respective lower portions connected to the bulb 141.

This arrangement facilitates an efficient transfer of loads from the flanges 121, 122 to the bulb 141 which provides the main tensile load bearing region of the beam 100 under typical loading conditions. It will be appreciated that the loading of the beam 100 due to its own weight and due to applied loads applied to the structure engaging surface 120 (such as the weight of any deck slab, any vehicles or any other objects supported by the bridge) will tend to induce bending of the beams 100 with the bulb 141 in a state of tension.

As discussed above, the diaphragms 131, 132 have a flange-supporting function in which they support the wide flanges 121, 122 of the beam 100 and enable loads applied to the flanges 121, 122 to be effectively transferred to other parts of the beam 100. In particular, the diaphragms 131, 132 will transfer loads onto the web 110 and to the bulb 141. The diaphragms 131, 132 provide a direct load path from adjacent of the flanges 121, 122 to the bulb 141 which results in far more effective transfer of applied loads to the bulb 141 than may be achieved by cantilevered support of the flanges 121, 122 alone.

Furthermore, the triangular shape of the diaphragms 131, 132 results in an efficient use of material for the purpose of providing this load path from the flanges 121, 122 to the bulb 141. The diaphragms each include a first diaphragm edge extending outwardly from the web 110 along the respective flange 121, 122 towards the respective edge 123, 124 of the beam 100 and a second diaphragm edge extending downwardly from the respective flange 121, 122 along the web 110 towards the bulb 141 for providing the portion of the diaphragm connected to the bulb 141. A third diaphragm edge extends diagonally between the outer end of the first diaphragm edge on the flange 121, 122 and the bulb 141 to thereby complete the generally triangular shape of the diaphragm 131, 132. It is noted that the second diaphragm edge and the third diaphragm edge do not necessarily meet at a point, but may instead effectively merge with the bulb 131 where the lower portion of the diaphragm 131, 132 is connected with the bulb 141.

As shown in the example embodiments referred to above, the bulb 141 may be formed having a generally rectangular cross section at the second elongate edge of the web 110 (i.e. at the base of the web), whereby the support surface 140 is provided by the lower side of the rectangular cross section. The bulb 141 may include chamfers extending between its main rectangular cross section and the thinner planar web 110 to provide a smooth transition between the web 110 and the bulb 141 portions of the beam 100. The lower portion of the diaphragm 131 may be connected to the bulb at via the chamfers.

As mentioned above, the bulb 141 may include an array of prestressed reinforcement members, and example arrangements of these prestressed reinforcement members are depicted in the aforementioned embodiments. The prestressed reinforcement members extend longitudinally along the bulb 141 and may be provided in a generally rectangular array to fill the generally rectangular cross section of the bulb 141. Preferably, the array of prestressed reinforcement members will be distributed evenly across the width and height of the rectangular cross section of the bulb. Some additional prestressed reinforcement members may be also provided in the chamfered region providing the transition between the bulb 141 and the flange 110.

It will be appreciated that the above discussed arrangements of the bulb 141 and diaphragms 131, 132 provides a particularly efficient structural configuration for supporting the thin wide flanges 121, 122 of the beam, by providing direct load paths from applied loads on the flanges 121, 122 to the reinforced bulb 141, via the triangular shaped diaphragms 131, 132 having their lower portions connected to the bulb 141.

The above arrangements enable beams to be provided with a wide geometry, in which the width of the flanges may be significantly greater than the overall depth of the beam. In conventional Super-Tee beams and other traditional beam configurations for bridge construction, the width of the beam is typically of a similar order as the depth of the beam. In contrast, a precast concrete beam may be provided in accordance with the above techniques having an overall width that is over twice the depth of the beam. For example, as discussed above with regard to the example of FIGS. 2A to 2G, a beam having a total length of about 30,800 mm may be provided with a width of about 3,420 mm and a depth of about 1,500 mm. Despite this wide aspect ratio, the flanges 121, 122 may be provided with very thin construction, having a thickness on the order of 80 mm. This is achievable largely due to the diaphragms 131, 132 supporting the flanges 121, 122 and transferring loads to the other parts of the beams, rather than needing to rely on cantilevering for transferring applied loads.

It should be understood that the precast concrete beam configurations described above provide an effective long span, wide flanged, prestressed super girder for the construction of highway bridges, or the like. Bridges can be constructed using precast concrete beams in accordance with the above examples with fewer beams for a given bridge width, whilst still providing long spanning capabilities with the ability to support heavy vehicle loading.

The structural arrangements disclosed above make it possible to provide a long span bridge beam in which the width of the top flange is, proportionally, significantly greater than the overall height of the beam, and still the beam is capable of spanning distances greater than conventional precast concrete beams for similar applications.

In particular, this capability is enabled by providing flange supporting diaphragms, which make it possible to provide extremely wide top flanges whilst maintaining a relatively shallow height and still being able to span such long load/spans. The enhanced structural support of the flanges provided by the diaphragms makes it structurally possible to provide flanges that are very thin (on the order of about 80 mm) yet significantly wider than conventional bridge beams. For instance, precast concrete beams may be provided with a thin flange with a width of 3400 mm which can span over 36.0 m and with a width of 1700 mm can span over 48.0 m, without requiring any post-tensioning work or temporary supports at the construction site. This can allow a significant reduction in the required number of beams for constructing a bridge structure having predetermined width and total length requirements. For instance, due to the greater flange width capability of the above described arrangements, fewer beams will be required to construct a bridge of the same width compared with conventional beams.

As described above, the beams provide the primary support for spanning large lengths, and provide an ability to support a large area of deck per single beam. There is also an ability to support a large area of deck per single beam. As mentioned, the use of wide flanges reduces the number of beams required. The beams will be able to span larger lengths due to their efficient design. These wide flanges can also provide for improved aesthetics due to the wide spacing between adjacent beams.

Due to the diaphragms, the beams also provide an ability to support large services across the span through the diaphragms, with minimal additional support. The overall strength added by the diaphragms can also make the bridge deck much more robust against accident vehicle collisions.

The beams can be precast with varying width so they can accommodate different shape decks such as curves and tapering decks. Due to the wide flanges, these can follow tight horizontal curves in the road and tapering bridge decks easily. Furthermore, when casting the beams, one form can be used for all the different girder heights and a complete girder can be cast in one pour, not multiple pours.

The beams nevertheless remain simple to install as part of a bridge construction project, with the beams supported at their ends by lateral support beams without requiring any awkward placement operations, such as pushing of the beams from one end in order to interlock them. There is no need for a bespoke headstock (coping) for the lateral support beams and as such the precast concrete beams can sit on any headstock. A bridge structure using the beams does not rely on the being transversely fixed together, so assembly time on site is reduced.

There is no need for any additional site assembly activities, such as bolting and stressing, once the beams are installed. The beams can be brought to site as a whole without further plant required on site to assemble the beams. No prestressing is required on site for the lateral support beams or for the main beams in the longitudinal direction. This reduces the likelihood of durability issues conventional prestressing strands will need to be grouted, which can have issues, when not completed properly on site. It is also noted that there are safety implications when stressing on site as it is in a less controlled environment than in a controlled workplace such as a precast yard. No work beneath the deck is required to install the beams in a bridge construction, which has safety implications for working at heights.

The precast concrete beams do not need any safety equipment to construct the deck once the beams have been installed as there are no voids in the deck and there is an immediate platform for personnel to walk the structure supporting surface of the flanges. In addition, the surfaces on the beams as described above may be smooth so as to eliminate areas where water can pond, birds roost, that can cause long term durability issues. In contrast, conventional Super-Tee beams include large voids before the deck is formed.

Further advantages of embodiments of the precast concrete beams as compared to the conventional Super-Tee beams, which have traditionally been the standard long span beam used in Australia, are outlined below.

Beams in accordance with the above described examples provide a stiffer section with a larger and more robust bottom flange, typically in the form of a bulb as described above, compared to the Super-Tee beam. The bottom flange and enhanced section stiffness allows greater prestress to be provided and still be controlled at transfer. This means that the beams can span longer lengths with the same depth as a Super-Tee beam (i.e. providing better span to depth ratios). This allows substantial savings in the substructure design of bridges.

Intermediate stiffeners, in the form of diaphragms as described above, are provided along the beam to support the shallow top flange, which increase the beam spacing without the need for sacrificial formwork. This provides a quick working surface and a reduction in the number of beams required. Beam length can be extended to achieve spans greater than that typical for a Super-Tee beam of identical depth. The robustness of the bottom flange also provides rigidity for accidental impacts when combined with the intermediate stiffeners/diaphragms.

A comparison of a 1500 mm deep precast concrete beam (3400 mm wide) and a 1500 mm deep Super-Tee beam (2000 mm wide) has been undertaken. By considering both beam cross-sections as 2000 mm wide only for direct comparative purposes we see that the beam section is 60% stiffer than a 1500 deep Super T and only 50% heavier. Even greater efficiency is achieved in the precast concrete beams with the composite action of the in situ deck slab. A significant potential saving here is that this means that the number of beams in a deck cross-section can be decreased.

Compared with the current bridge beams in Australia, the precast concrete beams as described above allow easier and safer manufacturing. The wider single web in comparison to the two narrower Super-Tee webs allows easier manufacturer and therefore better quality control. In addition no internal forms are required. The above mentioned ease of manufacture leads to a lower cost per tonne of beams. Based on a 24 hour production cycle, the number of beams for a typical bridge can be cast much quicker which leads to a lower cost, as there will be fewer beams required.

The wide flanges provide an immediate working platform with no requirement for sacrificial formwork. The wide flanges also allow for more flexibility in horizontal road geometry with tighter curves than current super tee bridge girders being catered for.

The wide beam spacing and additional stiffness from the section and bottom flange lead to a more efficient and lighter superstructure then current standard bridge girders in use in Australia. There are no perceived durability issues. The removal of enclosed voids removes potential durability issues with entrapped moisture. The intermediate stiffeners/diaphragms can also incorporate penetrations for services and lighting.

In view of the above, it will be appreciated that precast concrete beams formed in accordance with the above examples provide significant benefits compared to conventionally available beams and allow long span bridge structures to be provided more efficiently than previously achievable.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The claims defining the invention are as follows:

1. A precast concrete bridge beam for use in construction of a long span vehicle bridge structure, the beam including:

a) a substantially planar web extending longitudinally between ends of the beam;

b) a pair of flanges formed integrally with the web, each flange extending laterally from a first elongate edge of the web and extending longitudinally between the ends of the beam so as to define a structure engaging surface of the beam;

c) an enlarged bulb formed integrally with the web, the bulb extending along a second elongate edge of the web opposing the flanges, an array of prestressed reinforcement members being located inside the bulb;

d) a plurality of diaphragms formed integrally with the web and the flanges, each diaphragm spanning laterally between a side of the web and one of the flanges, wherein each diaphragm is substantially triangle shaped and a portion of each diaphragm is connected to the bulb, and wherein the diaphragms are spaced apart along the beam to thereby support the flanges; and, e) an end block at each end, each end block being formed integrally with an end portion of the web and having a substantially increased thickness compared to a thickness of the web.

2. A beam according to claim 1, wherein the beam is cast from concrete as a unitary body.

3. A beam according to claim 1, wherein the beam includes at least one pair of diaphragms such that the diaphragms in each pair span between respective sides of the web and respective flanges at the same longitudinal position along the beam.

4. A beam according to claim 3, wherein the beam includes a plurality of pairs of diaphragms, each pair of diaphragms being spaced apart by a spacing distance, and wherein the spacing distance is selected so that at least one of:

a) a load applied to an outer portion of one of the flanges will be transmitted to the web via one of the diaphragms;

b) the spacing distance is less than 30 times a flange thickness of the flanges; and, c) the spacing distance is between 20 times the flange thickness and 30 times the flange thickness.

5. A beam according to claim 1, wherein the beam includes a plurality of reinforcement members located inside the beam, and wherein at least some of the reinforcement members are prestressed when the beam is formed.

6. A beam according to claim 1, wherein the beam includes two secondary beams, each secondary beam being formed integrally with one of the flanges and extending longitudinally between ends of the beam, and wherein at least one of:

a) the two secondary beams are offset laterally from opposing sides of the web;

b) each secondary beam protrudes from the flange away from the structure engaging surface;

c) each secondary beam is located at an intermediate position with respect to the perpendicular extension of the respective flange from the web, such that an inner flange portion is defined between the web and the secondary beam and an outer flange portion is defined extending outwardly from the secondary beam;

d) each secondary beam is located at an outer edge of the flange;

e) each diaphragm terminates at a respective secondary beam; and, f) each secondary beam has a cross section profile of one of:

i) a square shape;

ii) a rectangular shape;

iii) a triangular shape;

iv) a rounded shape; and, v) a semi-circular shape.

7. A beam according to claim 1, wherein the structure engaging surface is at least one of:

a) a substantially planar surface; and, b) configured to engage a slab.

8. A beam according to claim 1, wherein at least one of the diaphragms includes a service hole for allowing services to be routed through the diaphragm.

9. A beam according to claim 1, wherein the flanges extend laterally from the web at an angle to define a sloped structure engaging surface.

10. A beam according to claim 1, wherein the beam includes laterally extending internal reinforcements at least at longitudinal positions coinciding with the diaphragms.

11. A beam according to claim 1, wherein the beam includes diagonal beams extending between adjacent diaphragms, and wherein the diagonal beams extend from a base of a first diaphragm to an end of a second diaphragm adjacent to the first diaphragm.

12. A beam according to claim 1, wherein the beam includes an integral slab portion formed integrally with the flanges, the integral slab portion defining a substantially planar slab surface of the beam.

13. A beam according to claim 12, wherein at least one of:

a) the slab surface is sloped relative to the web;

b) the integral slab portion is formed at least in part from thickened regions of the flanges;

c) the integral slab portion is formed such that the slab surface is aligned with a lateral extension direction of the flanges relative to the web; and, d) the web is substantially symmetrical about a longitudinally extending symmetry plane and the flanges extend laterally from the web at an angle relative to the symmetry plane, such that the slab surface is sloped relative to the symmetry plane.

14. A beam according to claim 12, wherein the beam includes a recessed region formed along an outer edge of the integral slab portion, to thereby allow adjacent beams to be joined by abutting respective outer edges of the adjacent beams so that the respective recessed regions form an effective joint recess and forming a concrete infill in the effective joint recess.

15. A beam according to claim 14, wherein the beam includes reinforcement members embedded into the flanges and protruding into the recessed regions, such that the concrete infill is reinforced by the reinforcement members when adjacent beams are joined.

16. A beam according to claim 14, wherein the beam includes reinforcement couplers embedded into the integral slab portion for supporting reinforcement bars protruding laterally across the recessed regions, such that the concrete infill is reinforced by the reinforcement bars when adjacent beams are joined.

17. A beam according to claim 16, wherein the reinforcement bars extend laterally beyond an outer edge of the beam to thereby protrude into an adjacent recessed region when adjacent beams are joined.

18. A beam according to claim 1, wherein the beam is used in construction of a long span vehicle bridge structure.

19. A long span vehicle bridge structure including a plurality of beams according to claim 1.

* * * * *